US010899029B1

(12) United States Patent
Atlason et al.

(10) Patent No.: US 10,899,029 B1
(45) Date of Patent: Jan. 26, 2021

(54) RAZOR COVER SYSTEM

(71) Applicant: Billie, Inc., New York, NY (US)

(72) Inventors: Hlynur Vagn Atlason, New York, NY (US); Jason Bravman, New York, NY (US); Georgina Gooley, Brooklyn, NY (US); Andres Marcos, Long Island City, NY (US)

(73) Assignee: Billie, Inc., New York, NY (US)

( * ) Notice: Subject to any disclaimer, the term of this patent is extended or adjusted under 35 U.S.C. 154(b) by 0 days.

(21) Appl. No.: 16/675,874

(22) Filed: Nov. 6, 2019

Related U.S. Application Data

(60) Provisional application No. 62/887,424, filed on Aug. 15, 2019.

(51) Int. Cl.
*B26B 21/40* (2006.01)
*A45D 27/22* (2006.01)

(52) U.S. Cl.
CPC ..... *B26B 21/4037* (2013.01); *A45D 27/225* (2013.01)

(58) Field of Classification Search
CPC .... B26B 21/4037; A45D 27/22; A45D 27/225
USPC ..... 30/541, 539, 540
See application file for complete search history.

(56) References Cited

U.S. PATENT DOCUMENTS 5,457,887 A * 10/1995 Grange ..... A45D 27/29 30/34.05
7,093,363 B1 * 8/2006 Kuo ..... B26B 21/40 30/32
8,757,370 B2 6/2014 Krok
8,770,398 B1 * 7/2014 Krok ..... A45D 27/46 206/204
D744,744 S 12/2015 Lee
9,380,850 B1 * 7/2016 Krok ..... A45D 27/225
10,104,950 B1 * 10/2018 Provost ..... A45D 27/29
2007/0220754 A1 * 9/2007 Barbaro ..... A46B 17/02 30/41
2009/0056151 A1 * 3/2009 Kohring ..... A45D 27/225 30/541
2018/0206611 A1 * 7/2018 Schaefer ..... B26B 19/3873

FOREIGN PATENT DOCUMENTS

FR 2173595 A5 * 10/1973 ..... A45D 27/225
FR 2608544 A2 * 6/1988 ..... B26B 1/40

OTHER PUBLICATIONS

English Translation of FR2608544. (Year: 1988).*

(Continued)

*Primary Examiner* — Jennifer B Swinney
(74) *Attorney, Agent, or Firm* — Lowenstein Sandler LLP

(57) ABSTRACT

A razor cover system includes a rear component, a front component, and a magnetic component. The front component is configured to couple with the rear component to form an inner volume of the razor cover system. At least a portion of the shaving razor is to be disposed in the inner volume of the razor cover system. The magnetic component is configured to couple to the rear component within the inner volume of the razor cover system. The magnetic component is configured to secure a portion of the handle to the rear component.

20 Claims, 21 Drawing Sheets

(56) References Cited

OTHER PUBLICATIONS

Go Travel Razor Guard. [online, Oct. 18, 2016], [retrieved on Sep. 10, 2020], Retrieved from the internet <url: https://www.amazon.com/Design-Go-Razor-Guard-Clear/product-reviews/B01G8II6V2/ref=cm_cr_getr_d_paging_btm_prev_1?ie=UTF8&reviewerType=all_reviews&pageNumber=1>. (Year: 2016).*

White Viscose Manual Shaver Rack. [online],[retrieved on Sep. 10, 2020],Retrieved from the internet<url:https://www.joom.com/en/products/5d47c5de36b54d0101bf4c5c?reviewsPage=2-9oYns-BmHpgaV1PrD7N1eMH4jXDpW_GVzynyZMPL9N6Bo3Jhd5TLQOhqAAAAAADLAAAAAAAAAADLQncYO2vZYAC4NWU2MjU2OTA2MDNiZGQzODAxZjJhYmV>. (Year: 2020).*

Steripod Razor Protector. [online, Mar. 18, 2018], retrieved on [Sep. 10, 2020]. Retrieved from the interview <url: https://www.target.com/p/steripod-razor-protector-trial-size-1ct/-/A-75003004>. (Year: 2018).*

* cited by examiner

RAZOR COVER SYSTEM

RELATED APPLICATIONS

This application claims the benefit of Provisional Patent Application No. 62/887,424, filed Aug. 15, 2019, the entire contents of which are incorporated by reference in their entirety.

TECHNICAL FIELD

Embodiments of the present disclosure relate to a cover, and in particular to a razor cover.

BACKGROUND

Shaving razors (e.g., safety shaving razors) may have a razor handle that is coupled to one or more razor blades. Shaving razors are used to sever hair from skin via the razor blades without cutting the skin. Mishandling of a shaving razor may result in injury, damage of the razor blades resulting in poor shaving, or damage of other objects.

BRIEF DESCRIPTION OF THE DRAWINGS

The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION OF EMBODIMENTS

Figure 1:
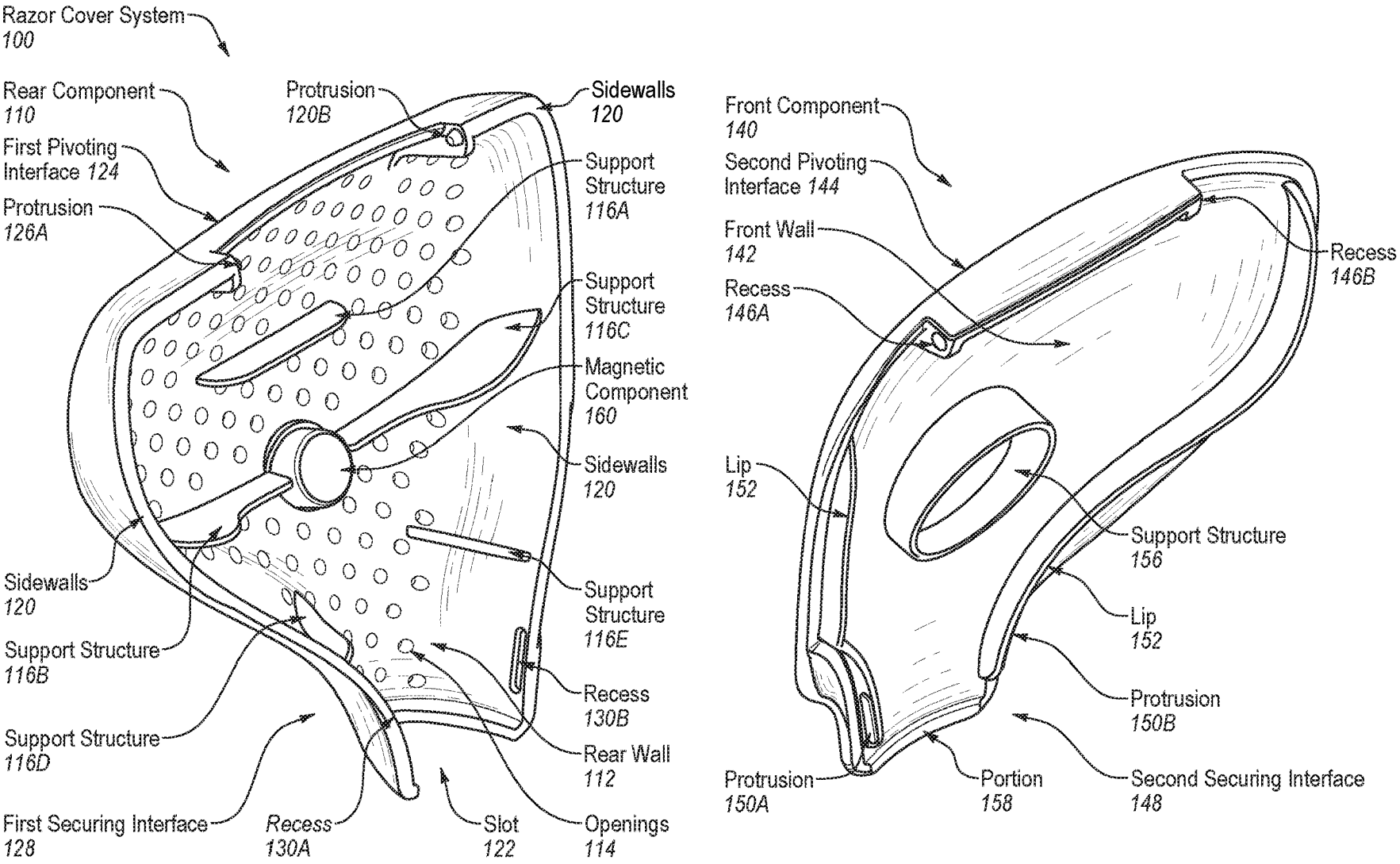
FIG. 1 illustrates a razor cover system including a rear component, a front component, and a magnetic component, according to certain embodiments.

Embodiments described herein are related to a razor cover system. Shaving razors (e.g., safety shaving razors) include a handle coupled to razor blades (e.g., disposed in a razor cartridge). The razor blades may be extremely sharp to provide a good shave. Razor blades that are dull, have burrs, or are otherwise damaged may cause nicks, cuts, and skin irritation during shaving. Dropping of shaving razors, contact of razor blades with other objects, moisture on razor blades over prolonged periods of time, and so forth may damage the razor blades. Contact of razor blades with other objects and unintended contact of razor blades by a user may cause injury and damage to objects.

Conventional covers may unexpectedly open and allow a shaving razor to fall out. For example, a shaving razor partially covered with a cover may be dropped or placed in a bag, causing the cover to contact other objects and open unexpectedly. The shaving razor that has fallen out of a cover may become damaged, cause damage, and/or cause injury. For example, razor blades of a shaving razor may injure a user that puts their hand in a bag responsive to the shaving razor having unexpectedly fallen out of a cover in the bag.

A shaving razor may have one or more sensitive portions. For example, the razor blades, lubrication portion of the cartridge, and so forth may become damaged. Contact with the razor blades by objects or prolonged contact by moisture with the razor blades may cause the razor blades to become dull, have burrs, or otherwise be damaged. Contact with the lubrication portion or prolonged contact by moisture with the lubrication portion may cause the lubrication portion to degrade, chip, or otherwise be damaged. Conventional covers may contact the razor blades and/or lubrication portion and may cause the razor blades and/or lubrication portion to have prolonged contact by moisture, and may shorten (e.g., due to damage, etc.) the lifespan of the razor blades and/or lubrication portion.

The devices, systems, and methods disclosed herein provide a razor cover system (e.g., razor travel cover system). The razor cover system may include a rear component, a front component, and a magnetic component. The rear component may include a first interface and the front component may include a second interface configured to couple to the first interface to form an inner volume of the razor cover system. The razor cover system may be configured to receive at least a portion of a shaving razor within the inner volume of the razor cover system. The rear component and the front component may include one or more support structures configured to contact one or more portions of the shaving razor without contacting the razor blades and without contacting any lubrication portions of the shaving razor. The magnetic component may be configured to couple to the rear component within the inner volume of the razor cover system. The magnetic component may be configured to secure a portion of the handle of the shaving razor to the rear component. The magnetic component may secure the shaving razor to the rear component with or without the front component being coupled to the rear component.

The systems, devices, and methods disclosed herein have advantages over conventional solutions. The razor cover system may secure the shaving razor via magnetic attraction to the rear component even without having the front component secured to the rear component to prevent injury to users, damage of the shaving razor, and damage of other objects. The razor cover system may have support structures configured so that the razor cover system secures the shaving razor without contacting the razor blades and the lubrication portions of the shaving razor to prevent damage of the shaving razor.

FIG. 1 illustrates a razor cover system 100 including a rear component 110, a front component 140, and a magnetic component 160, according to certain embodiments. The razor cover system 100 may be a razor travel cover, a razor travel case, a razor protection cover, or the like.

The rear component 110 may include a rear wall 112 and sidewalls 120. The rear wall 112 may have an outer surface and an inner surface. The rear wall 112 may form one or more openings 114 (e.g., perforations, slots, holes, etc.) between the outer surface and the inner surface to provide for drainage of the razor cover system 100 and to provide for air flow through the razor cover system 100. The one or more openings 114 may allow the razor blades and lubrication portions of the shaving razor to dry to prevent damage of the razor blades and lubrication portions. In some embodiments, the rear wall 112 forms a plurality of openings 114 that are evenly spaced throughout the rear wall 112. In some embodiments, the rear wall 112 forms one or more openings proximate the razor blades and/or lubrication portion (e.g., the cartridge) of the shaving razor. In some embodiments, the rear wall 112 does not have any openings 114 between the outer surface and the inner surface.

In some embodiments, the rear wall 112 is shaped to substantially conform to the shape of the shaving razor. The perimeter of the rear wall 112 may have a greater width closer to the razor blades (e.g., cartridge of razor blades) and a smaller width closer to the handle of the shaving razor. The rear wall 112 may be sloped to substantially conform to the shape of the shaving razor. The portion of the rear wall 112 closer to the razor blades may be lower and the portion of the rear wall 112 closer to the handle may be higher.

The sidewalls 120 may extend from the rear wall 112 to form an edge at a location offset from the rear wall 112. In some embodiments, the sidewalls 120 are curved from the rear wall 112 to the edge. In some embodiments, the edge has substantially the same slope as the rear wall 112 (e.g., as the outer surface and/or inner surface of the rear wall). The sidewalls 120 (e.g., the edge of the sidewalls 120) may form a slot 122 configured to receive a portion of a handle of a shaving razor.

The sidewalls 120 may include a first pivoting interface 124 that may include a first protrusion 126A and a second protrusion 126B (hereinafter "protrusions 126"). The first and second protrusions 126 may be substantially symmetrical and centered about substantially the same axis. The sidewalls 120 may include a first securing interface 128 that may include a first recess 130A and a second recess 130B (hereinafter "recesses 130"). The first and second recesses 130 may be substantially symmetrical and may be aligned with each other along an inner surface of the sidewalls 120 proximate the slot 122.

The rear wall 112 may be coupled to one or more support structures 116. For example, the rear wall 112 may be coupled to a first support structure 116A that is configured to be disposed against a portion of the cartridge of the shaving razor without contacting the razor blades and without contacting the lubrication portions to avoid damage of the razor blades and the lubrication portion and to allow the razor blades and the lubrication portion to dry. The rear wall 112 may be coupled to a second support structure 116B and a third support structure 116C that are configured to be disposed against portions of the handle of the shaving razor. The second and third support structures 116B-C may be configured to be disposed against portions of the handle proximate a magnetic portion of the handle. At least a portion of the second and third support structures 116B-C may be coupled to the sidewalls 120. The rear wall 112 and/or sidewalls may be coupled to a fourth support structure 116D and a fifth support structure 116E. The fourth and fifth support structures 116D-E may be configured to be disposed against portions of the handle of the shaving razor.

A magnetic component 160 may be coupled to the rear wall 112 of the rear component 110. The magnetic component 160 may be coupled to the rear wall 112 via adhesion, press fit, etc. The magnetic component 160 may be configured to secure the handle of the shaving razor to the rear component 110 via magnetic attraction.

The magnetic component 160 may be coupled to the rear wall 112 between the second and third support structures 116B-C. The magnetic component 160 may be cylindrical (e.g., two planar faces and a circular perimeter), where a first face of the magnetic component 160 is coupled to the rear wall 112, a second face of the magnetic component is for securing the handle via magnetic attraction, and the circular perimeter fits between the second and third support structures 116B-C. Distal ends of the second and third support structures 116B-C may align with a center of the circular perimeter.

The support structures 116A-E may be configured to contact (e.g., support) the shaving razor without contacting the razor blades and without contacting the lubrication portions responsive to the shaving razor being secured by the magnetic portion 160 to the rear component 110 via magnetic attraction.

The front component 140 may include a front wall 142. The front wall 142 may include a second pivoting interface 144 that may forms a first recess 146A and a second recess 146B (hereinafter "recesses 146"). The first and second recesses 146 may be substantially symmetrical and centered about substantially the same axis. The front component 140 may include a second securing interface 148 that includes a first protrusion 150A and a second protrusion 150B (hereinafter protrusions 150). The first and second protrusions 150 may be substantially symmetrical and may be aligned with each other. The front wall 142 may have an outer perimeter that is substantially the same as the outer perimeter of the sidewalls 120 of the rear component 110. The front wall 142 may be coupled to a lip 152 that has an outer perimeter that is substantially the same as the inner perimeter of the sidewalls 120 of the rear component 110. The lip 152 and the sidewalls 120 may form a pressure fit. In some embodiments, the protrusions 150 may be disposed on an outer surface of the lip 152 to secure to the recesses 130 that are formed by the inner surface of the sidewalls 120.

In some embodiments, the front wall 142 may be coupled to one or more support structures 156. The one or more support structures 156 may be configured to be disposed against a portion of the shaving razor (e.g., the handle) without contacting the razor blades and without contacting the lubrication portion. In some embodiments, the one or more support structures 156 may contact the shaving razor without contacting any components (e.g., interface, buttons, etc.) of the shaving razor. A support structure 156 may be configured to secure to a portion of the handle of the shaving razor around a component (e.g., button) of the handle of the shaving razor. The support structure 156 may form a protrusion with a circular outer perimeter and a circular inner perimeter (e.g., forming a ring structure). In some embodiments, the circular inner perimeter of the support structure 156 may be configured to secure to the handle around a component (e.g., a circular button) that has a circular outer perimeter. In some embodiments, the support structure 156 may be configured to interface with (e.g., secure against) the component (e.g., button) of handle.

The rear component 110 and the front component 140 may be configured to couple to each other to form an inner volume 102 of the razor cover system 100. The first pivoting interface 124 of the rear component 110 and the second pivoting interface 144 of the front component 140 may couple together to allow the rear component 110 and front component 140 to pivot relative to each other. The rear component 110 and front component 140 may pivot relative to each other to have access to the inner volume 102 of the razor cover system 100 (e.g., to remove the shaving razor from or place the shaving razor in the inner volume 102).

The first securing interface 128 of the rear component 110 and the second securing interface 148 of the front component 140 may couple together to prevent pivoting of the rear component 110 and front component 140 relative to each other. In some embodiments, the first pivoting interface 124 and the second pivoting interface 144 may be coupled to allow access to the inner volume 102 without completely separating the rear component 110 and the front component 140. The first securing interface 128 and the second securing interface 148 may be coupled to enclose (e.g., prevent access) to the inner volume 102.

The shaving razor may be placed on the support structures 116 of the rear component 110 (e.g., and secured to the rear component 110 via magnetic attraction between the shaving razor and the magnetic component 160) and then the front component 140 may be secured to the rear component 110 (e.g., via the pivoting interfaces 124, 144 and/or securing interfaces 128, 148) to enclose at least a portion of the shaving razor in the inner volume 102 (e.g., responsive to the rear component 110 and the front component 140 being in a closed state). The portion of the shaving razor enclosed in the inner volume 102 may include one or more of the razor blades, the lubrication portion, the cartridge including razor blades and lubrication portion, the interface between the handle and the cartridge, a button of the handle that is used to uncouple the handle and the cartridge, an upper portion of the handle, or the like. Responsive to the at least a portion of the shaving razor being enclosed in the inner volume, the magnetic component 160, the support structures 116A-E of the rear component 110, and the support structure 156 of the front component 140 may be secured against the shaving razor without the razor cover system 100 contacting the razor blades and without the razor cover system 100 contacting the lubrication portion. The razor cover system 100 may secure the shaving razor so that the razor cover system 100 does not contact the razor blades and does not contact the lubrication portion during vibration, impact, external forces, or the like. The rear component 110 (e.g., even without being coupled to the front component 140) may secure the shaving razor so that the razor cover system 100 (e.g., and other objects) does not contact the razor blades and does not contact the lubrication portion during vibration, impact, external forces, or the like.

In some embodiments, two or more of the rear wall 112, sidewalls 120, first pivoting interface 124, protrusions 126, or support structures 116 are integral to each other. In some embodiments, the rear wall 112, sidewalls 120, first pivoting interface 124, protrusions 126, and support structures 116 form one integral component (e.g., the rear component 110). In some embodiments, one or more of the rear wall 112, sidewalls 120, first pivoting interface 124, protrusions 126, or support structures 116 are coupled to each other (e.g., via adhesion, bonding, fasteners, or the like).

In some embodiments, the magnetic component 160 and the rear component 110 are integral to each other (e.g., the rear component 110 is magnetic). In some embodiments, the magnetic component 160 and the rear wall 112 are integral to each other (e.g., the rear wall 112 is magnetic). In some embodiments, the magnetic component 160 and one or more support structures 116 (e.g., support structures 116B and/or 116C) are integral to each other.

In some embodiments, the magnetic component 160 comprises a magnetic portion 162 and a cap 164. The cap 164 may be cylindrical and may form a cylindrical chamber (e.g., the cap 164 may have an outer face, a circular outer perimeter, circular inner perimeter, and an opening opposite the outer face that allows access to the cylindrical chamber). The magnetic portion 162 may fit inside the cap 164 and the cap 164 may secure to the rear wall 112 and/or the support structures 116B-C via one or more of ultrasonic plastic welding, adhesive, fasteners, pressure fit (e.g., snap into place), or the like. The cap 164 may be thin to not obstruct the magnetic attraction of the magnetic portion 162. In some embodiments, the cap 164 is integral with one or more other components (e.g., support structures 116B and/or 116C, rear wall 112, etc.).

In some embodiments, two or more of the front wall 142, second pivoting interface 144, protrusions 150, lip 152, or support structure 156 are integral to each other. In some embodiments, the front wall 142, second pivoting interface 144, protrusions 150, lip 152, and support structure 156 form one integral component (e.g., the front component 140). In some embodiments, one or more of the front wall 142, second pivoting interface 144, protrusions 150, lip 152, or support structure 156 are coupled to each other (e.g., via adhesion, bonding, fasteners, or the like).

In some embodiments, the razor cover system 100 forms a handle opening 104 via the slot 122 formed by the sidewalls 120 of the rear component 110 and a portion 158 of the front component 140 (e.g., a portion of the front wall 142 proximate the perimeter of the front component 140, a portion of the lip 152 proximate the perimeter of the front component 140, a feature protruding from the front wall 142 proximate the perimeter of the front component 140, etc.). The handle opening 104 may be sized to secure around the handle of the shaving razor. The razor cover system 100 may secure the shaving razor via one or more of the magnetic component 160, the portion of the sidewalls 120 and portion 158 that form the handle opening 104, support structures 116, or the like to prevent movement (e.g., preventing bouncing, jiggling, or the like) of the shaving razor within the razor cover system 100 and to prevent contact of the razor blades and lubrication portion.

In some embodiments, the razor cover system 100 may not have support structures 116, 156. The razor cover system 100 may secure a shaving razor without contacting the razor blades and lubrication portion via the magnetic component 160 (e.g., without support structures 116, 156). In some embodiments, the razor cover system 100 may not have the magnetic component 160. The razor cover system 100 may secure a shaving razor without contacting the razor blades and lubrication portion via the support structures 116, 156 (e.g., without magnetic component 160).

In some embodiments, the rear component 110 and the front component 140 are separate components that are joined together via one or more of a pressure fit, a hinge structure, one or more clips, or the like. FIG. 1 illustrates locations of protrusions and recesses (e.g., and sidewall and lip) for coupling the rear component 110 and front component 140. In some embodiments, the location and number of protrusions and recesses may vary from those shown in FIG. 1.

In some embodiments, the rear component 110 and the front component 140 are parts of a single component (e.g., are integral to each other). The rear component 110 and front component 140 may be joined by a living hinge (e.g., a thin flexible hinge that is flexure bearing and is made from the same material as the two rigid pieces it connects). The rear component 110, front component 140, and living hinge may be integral (e.g., one single component, formed by one single mold).

The razor cover system 100 may be may be made of one or more materials including polyethylene terephthalate (PET or PETE), high density (HD) PETE, thermoplastic polymer, polypropylene, oriented polypropylene, polyurethane, polystyrene, acrylonitrile butadiene styrene (ABS), polyvinyl chloride (PVC), polytetrafluoroethylene (PTFE), polyester, metal, synthetic rubber, natural rubber, silicone, nylon, polymer, wood, antibacterial or antimicrobial materials, insulating, thermal, other suitable sustainable or biodegradable materials, or any combination thereof. The razor cover system may be made of a material that could be colored or plated to look like metal, wood, or other materials. In some embodiments, each of the components (other than the magnetic portion 162) of the razor cover system 100 are the same type of material. In some embodiments, two or more components of the razor cover system 100 (other than the magnetic portion 162) are different types of material.

FIGS. 2A-D illustrate a razor cover system 100 coupled to a shaving razor 200, according to certain embodiments. Shaving razor 200 may have a handle 210, a component 220 (e.g., user interface, button), and an interface 230. A cartridge that includes razor blades and a lubrication portion may be coupled to the handle 210 via the interface 230. The component 220 (e.g., button) may be actuated to release the cartridge from the interface.

Figures 2A, 2B, 2C, 2D:
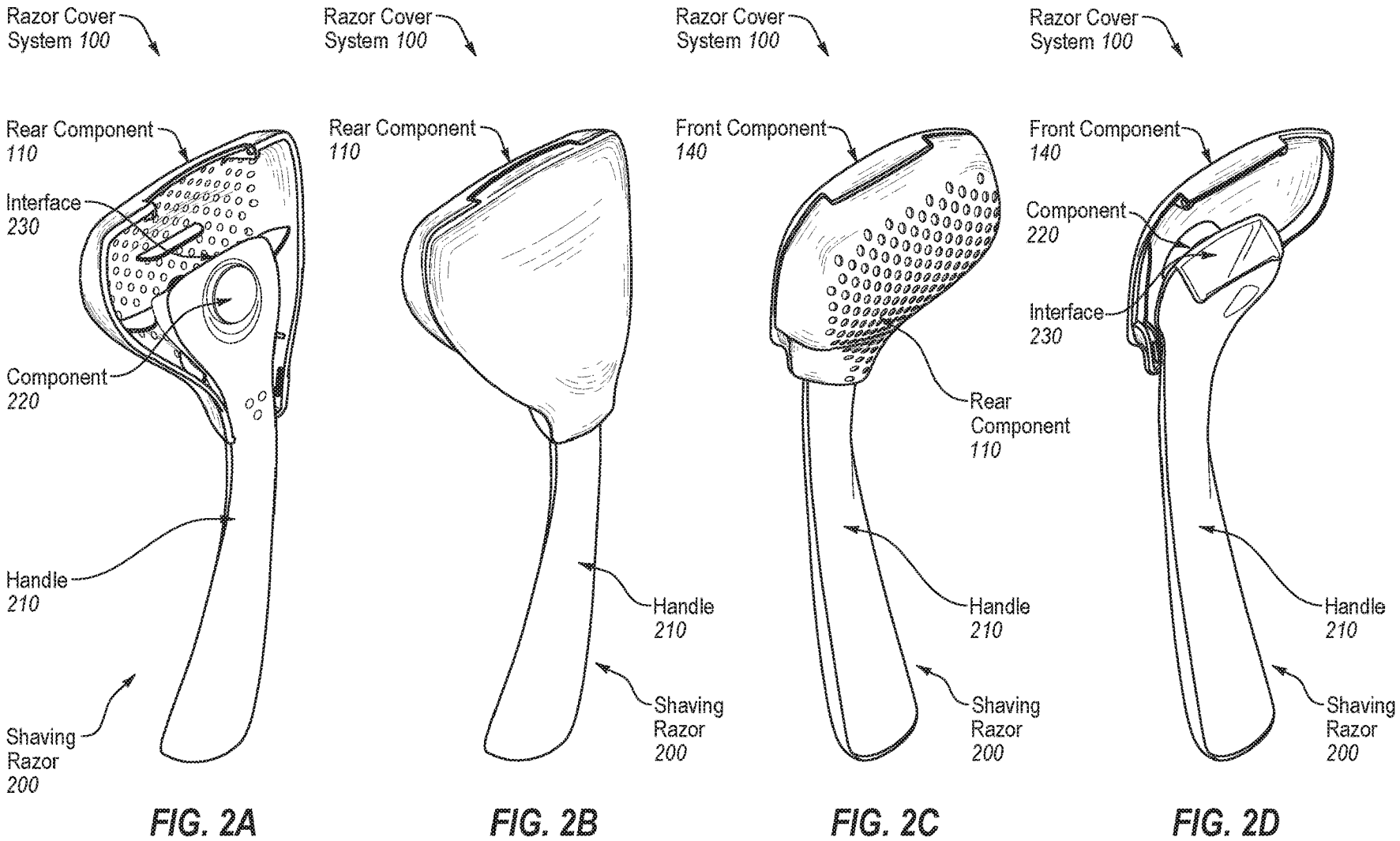
FIGS. 2A-D illustrate perspective views of a razor cover system coupled to a shaving razor, according to certain embodiments.

Referring to FIG. 2A, the shaving razor 200 may be disposed in the rear component 110 of the razor cover system 100. The shaving razor 200 may be secured by one or more of the magnetic portion 162, support structures 116, or the portion of the sidewalls 120 that form the slot 122 (see FIG. 1).

Referring to FIGS. 2B-C, the front component 140 may be coupled to the rear component 110 to secure at least a portion of the shaving razor 200 within the inner volume 102 of the razor cover system 100.

Referring to FIG. 2D, the front component 140 may have a support structure 156 that is configured to be disposed around the component 220, in some embodiments. Responsive to the front component 140 being coupled to the rear component 110, the support structure 156 may be disposed on a top surface of the handle 210 (e.g., around the component 220, interfacing with the component 220, etc.).

Figure 3B:
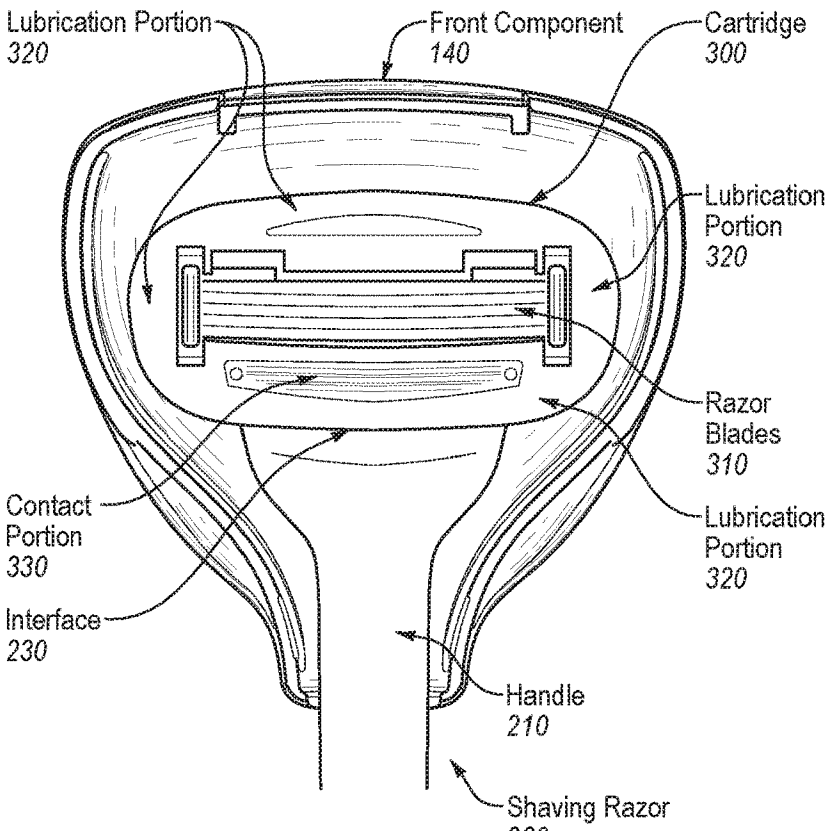
FIG. 3B illustrates a shaving razor disposed against a front component of a razor cover system, according to certain embodiments.
Figure 3A:
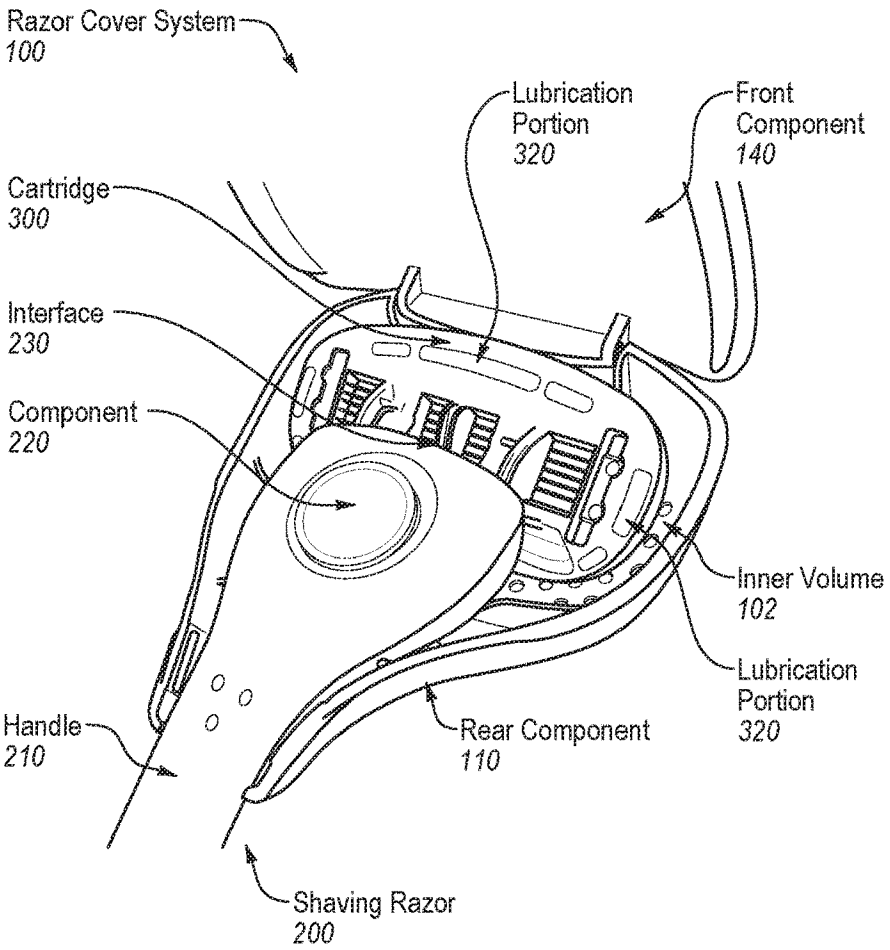
FIG. 3A illustrates a shaving razor disposed in a razor cover system, according to certain embodiments.

FIG. 3A illustrates a shaving razor 200 disposed in a razor cover system 100, according to certain embodiments. FIG. 3B illustrates a shaving razor 200 disposed against a front component 140 of a razor cover system 100, according to certain embodiments. The razor cover system 100 may include a rear component 110 and a front component 140. At least a portion of a shaving razor 200 may be placed in an inner volume 102 formed by the razor cover system 100.

The shaving razor 200 may include a handle 210, a component 220, and an interface. The shaving razor 200 may include or may be coupled to a cartridge 300. The cartridge 300 may include one or more razor blades 310. The cartridge 300 may include a lubrication portion 320. The lubrication portion 320 (e.g., lubricating strip, 360 degrees of lubrication, etc.) may include a lubricating composition (e.g., a shave-aiding agent) that is molded onto the cartridge 300. The lubrication portion 320 may be at least partially water soluble. In response to coming in contact with water, a portion of the lubrication portion 320 may dissolve to assist with shaving (e.g., the dissolved portion of the lubrication portion 320 may come in contact with the skin and/or razor blades to assist with shaving).

The lubrication portion 320 may be disposed on a front face of the cartridge above, to the sides, and below the razor blades 310 (e.g., 360 degrees of lubricating composition around the razor blades). The cartridge 300 may have openings that go from the front face of the cartridge 300 to the rear face of the cartridge. The lubrication portion 320 may be molded onto the front face of the cartridge 300 (e.g., around the razor blades 310) and through the openings in the cartridge 300. If a moist surface were to contact the lubrication portion 320 (e.g., on the front face or rear face of the cartridge) over a period of time, the lubrication portion 320 may dissolve which reduces the lifetime of the cartridge 300, reduces the quality of shave provided by the cartridge, and may cause damage to other objects.

The cartridge may have a contact portion 330 (e.g., on the front face of the cartridge 300). The contact portion 330 may be made of rubber, plastic, metal, etc. The contact portion 330 may not be covered with a lubrication composition. The contact portion 330 may be disposed on the front face of the cartridge 300 between the razor blades 310 and the lubrication portion 320. Upon placing the shaving razor 200 in the inner volume of the razor cover system 100 (e.g., securing the shaving razor 200 to the magnetic portion 160, placing the shaving razor on the support structures 116, etc.), the support structure 116A may contact the contact portion 330 of the cartridge 300. The razor cover system 100 may be configured to have the support structure 116A contact the contact portion 330 and not contact the razor blades 310 or lubrication portion 320. The razor cover system 100 may secure the shaving razor 200 so that the support structure 116A only contacts the contact portion (e.g., without contacting the razor blades 310 or lubrication portion 320) during vibration, impact, or other external forces on the razor cover system 100 and/or shaving razor 200. The razor cover system 100 may secure the shaving razor so that none of the lubrication portion 320 (e.g., on the front face of the cartridge 300, through the openings in the cartridge 300, on the back face of the cartridge 300, etc.) come in contact with the razor cover system 100. The lubrication portion 320 and razor blades 310 may be suspended in the razor cover system 100 without contacting any portions of the razor cover system 100. The openings 114 in the razor cover system may allow the lubrication portion 320 and/or razor blades 310 to dry to prevent dissolving of the lubrication portion 320 and damage of the razor blades 310.

FIGS. 4A-D illustrate perspective views of a rear component 110 of a razor cover system 100, according to certain embodiments.

Figure 4A:
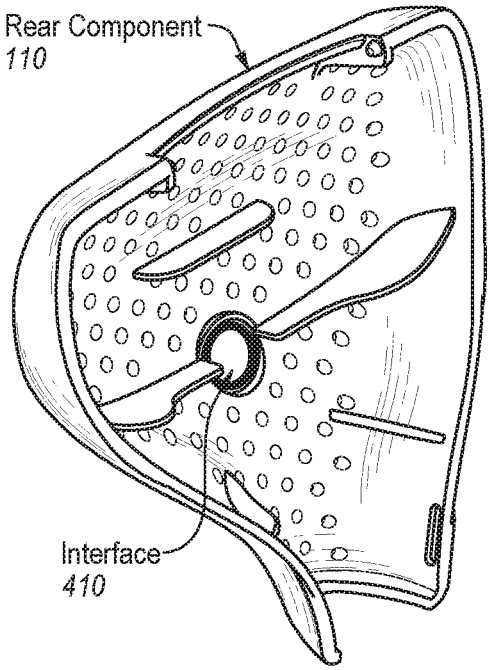
FIGS. 4A-D illustrate perspective views of a rear component of a razor cover system, according to certain embodiments.

Referring to FIG. 4A, the rear wall 112 of the rear component 110 may have an interface 410 to receive a magnetic component 160. In some embodiments, the interface 410 is formed by the rear wall 112. In some embodiments, the interface 410 is coupled to the rear wall 112. In some embodiments, the interface is 410 is a flat portion of the rear wall 112 (e.g., that does not have any openings 114).

Figure 4B:
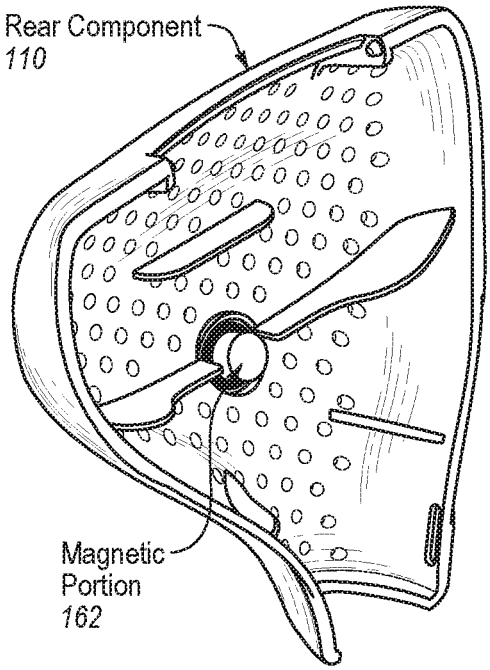

Referring to FIG. 4B, the magnetic portion 162 of the magnetic component 160 may be disposed on the interface 410. In some embodiments, the magnetic portion 162 is adhered to the interface 410. In some embodiments, the magnetic portion 162 is pressure fit on the interface 410. In some embodiments, the magnetic portion 162 is disposed on (e.g., aligned with) the interface 410 without being attached to the interface 410.

Figure 4C:
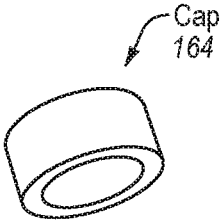

Referring to FIG. 4C, a cap 164 may be configured to be placed over the magnetic portion 162 on the interface 410. In some embodiments, the diameter of the inner perimeter of the cap 164 is substantially similar to the diameter of the outer perimeter of the magnetic portion 162. In some embodiments, the inner height of the cap 164 is substantially similar to the height of the magnetic portion 162.

Figure 4D:
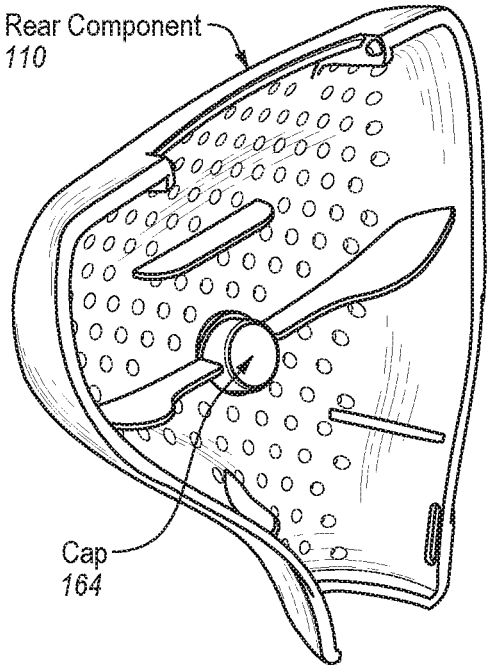

Referring to FIG. 4D, the cap 164 may be placed on the magnetic portion 162. In some embodiments, the magnetic portion 162 is coupled to the interface 410 and the cap 164 is coupled to the magnetic portion 162 (e.g., the cap 164 is not directly coupled to the interface 410). In some embodiments, the cap 164 is placed on the magnetic portion 162 and the cap 164 is coupled to the interface 410 via one or more of ultrasonic plastic welding, adhesion, fasteners, or the like (e.g., the magnetic portion 162 is not directly coupled to the interface 410).

Figure 5A:
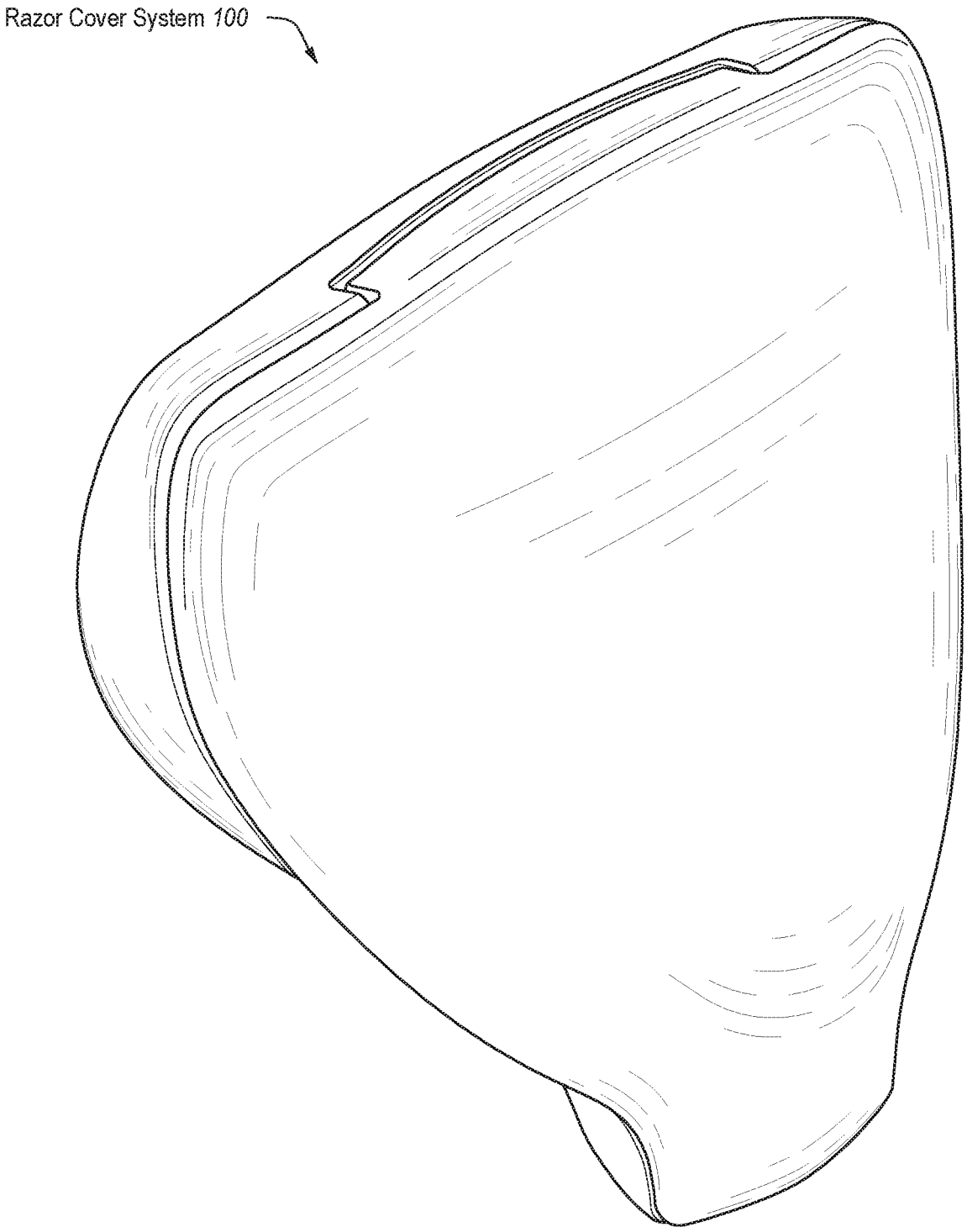
FIGS. 5A-H illustrate views of a rear component of a razor cover system coupled to a front component of a razor cover system, according to certain embodiments.
Figure 5B:
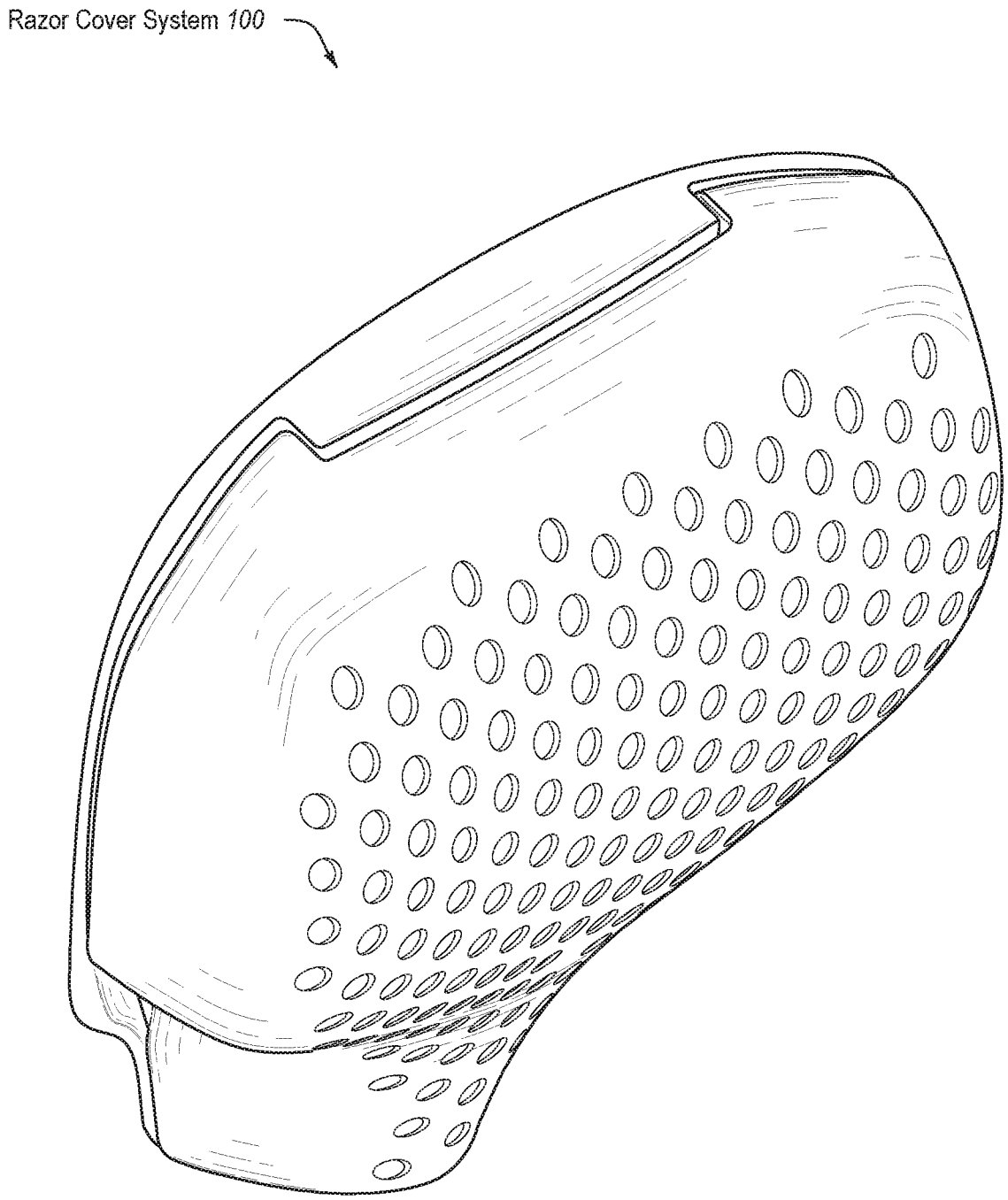
Figure 5C:
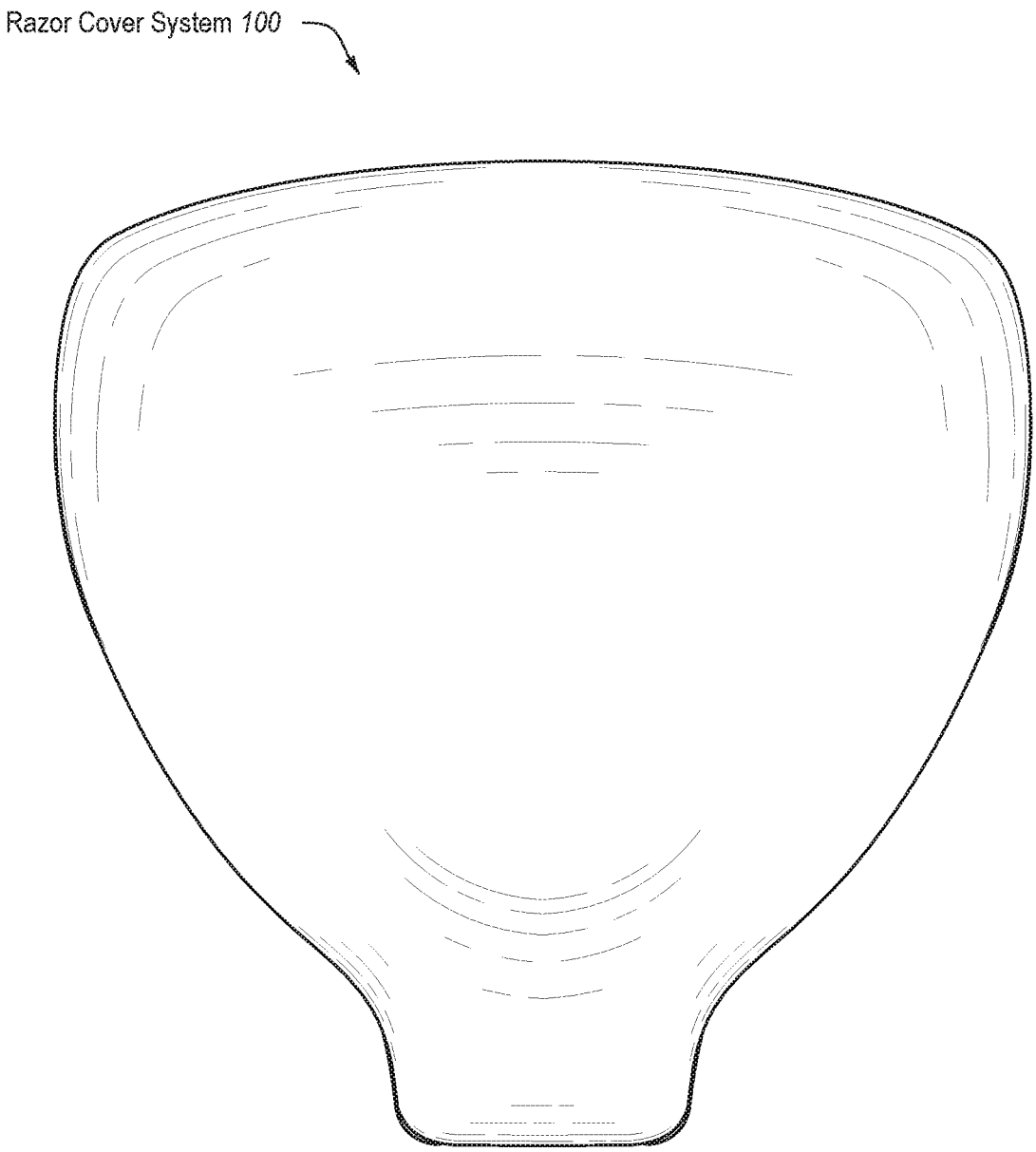
Figure 5D:
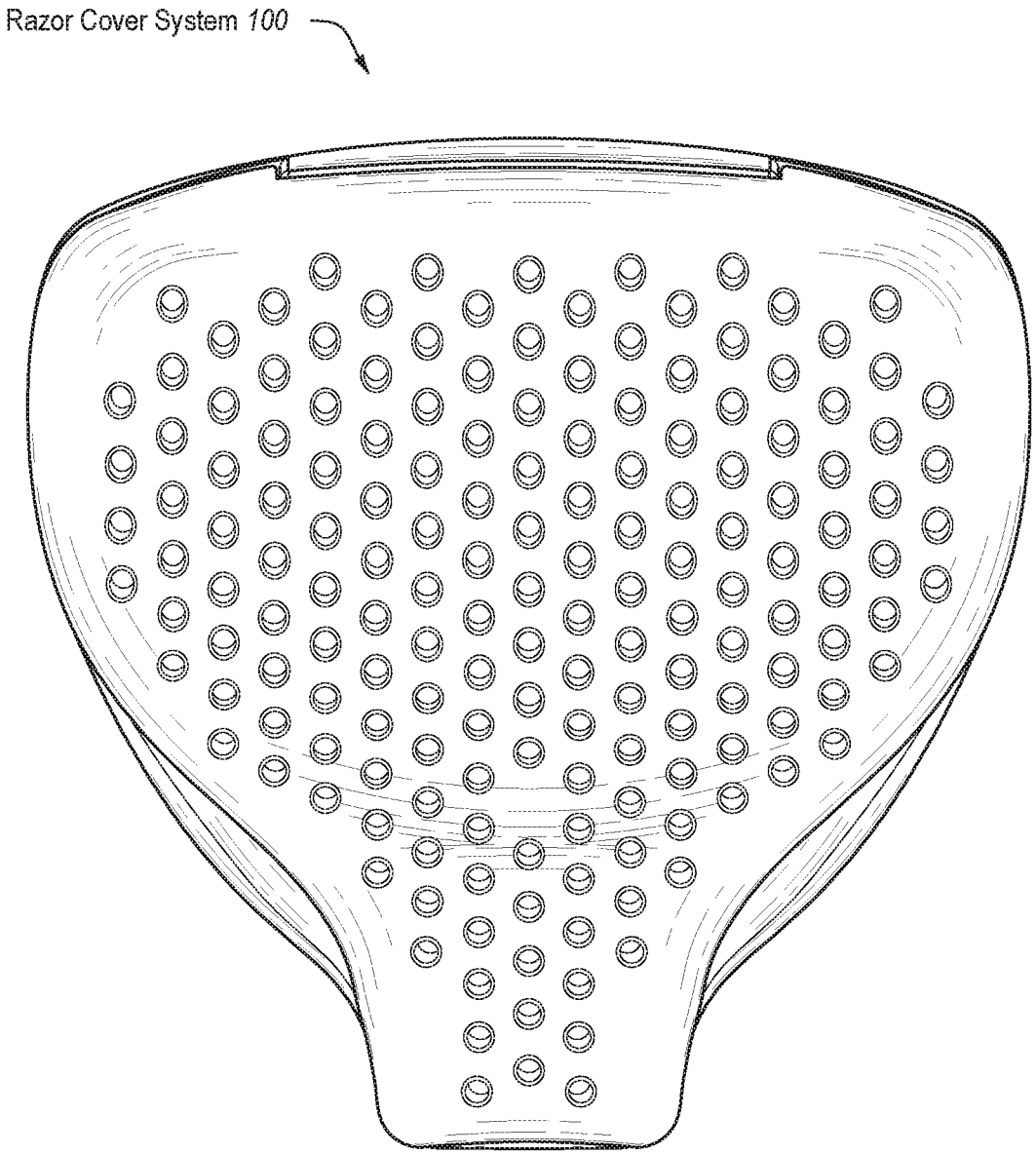
Figure 5E:
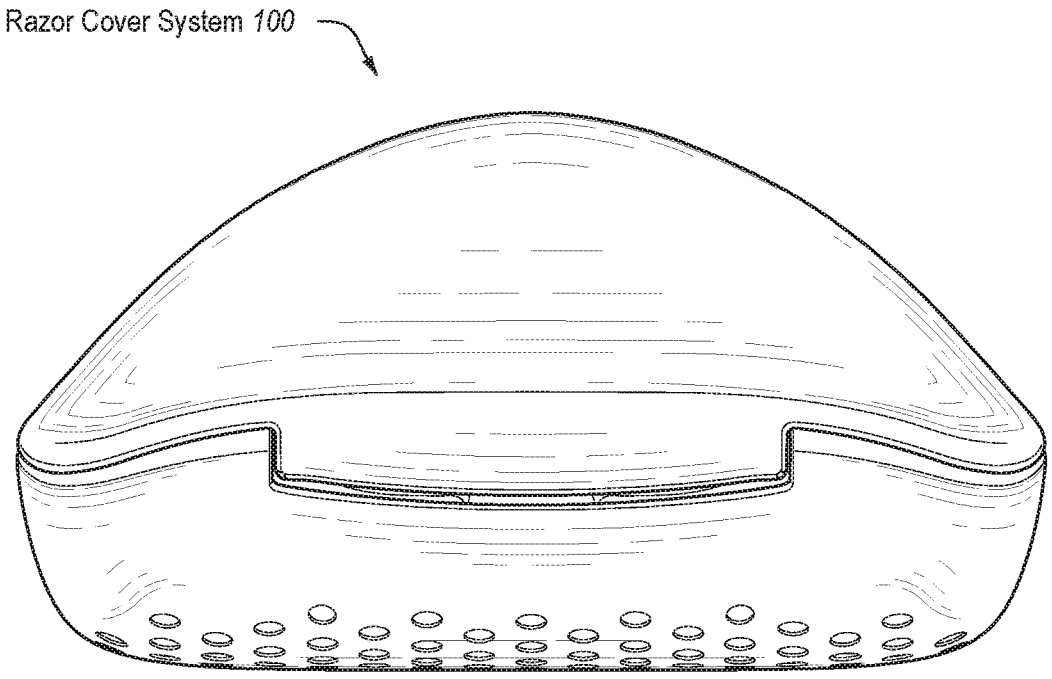
Figure 5F:
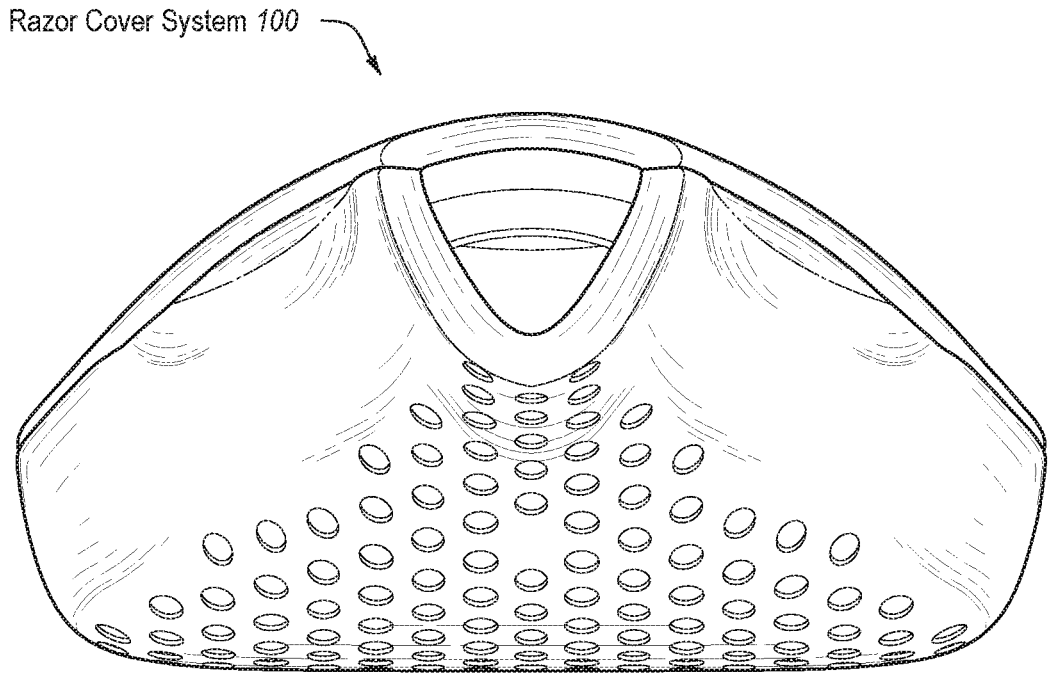
Figure 5G:
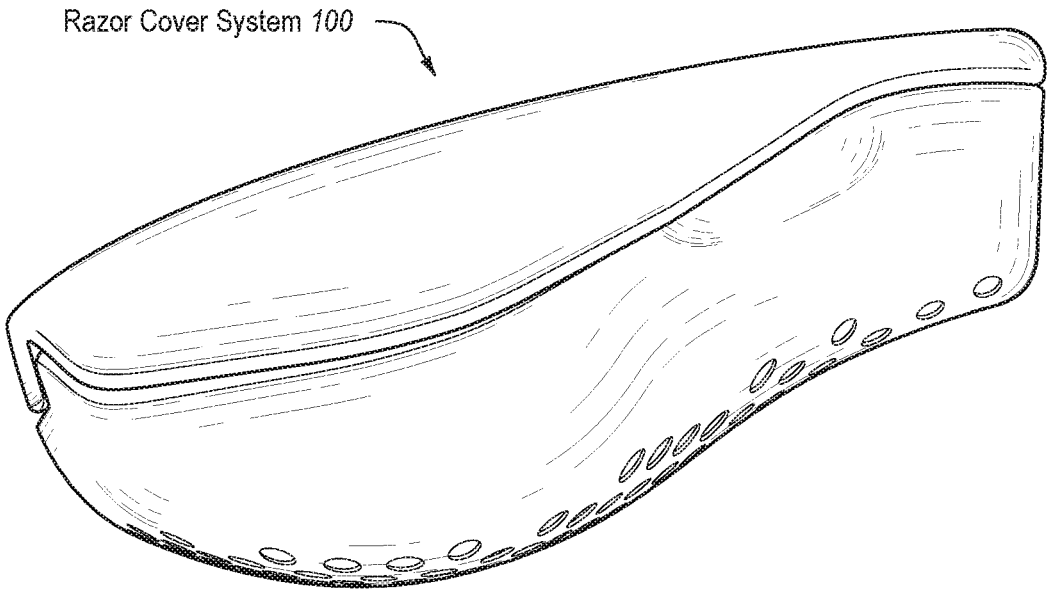
Figure 5H:
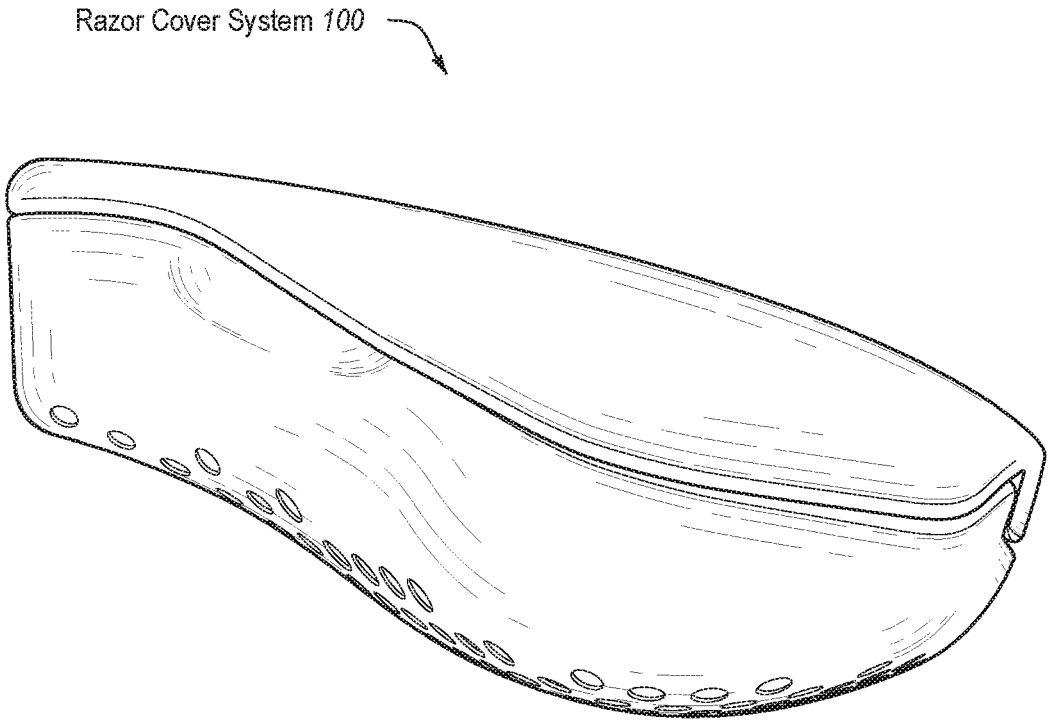

FIGS. 5A-H illustrate views of a rear component 110 of a razor cover system 100 coupled to a front component 140 of the razor cover system 100, according to certain embodiments. FIG. 5A may be a front perspective view, FIG. 5B may be a rear perspective view, FIG. 5C may be a front view, FIG. 5D may be a rear view, FIG. 5E may be a top view, FIG. 5F may be a bottom view, FIG. 5G may be a left side elevation view, and FIG. 5H may be a right side elevation view.

Figure 6A:
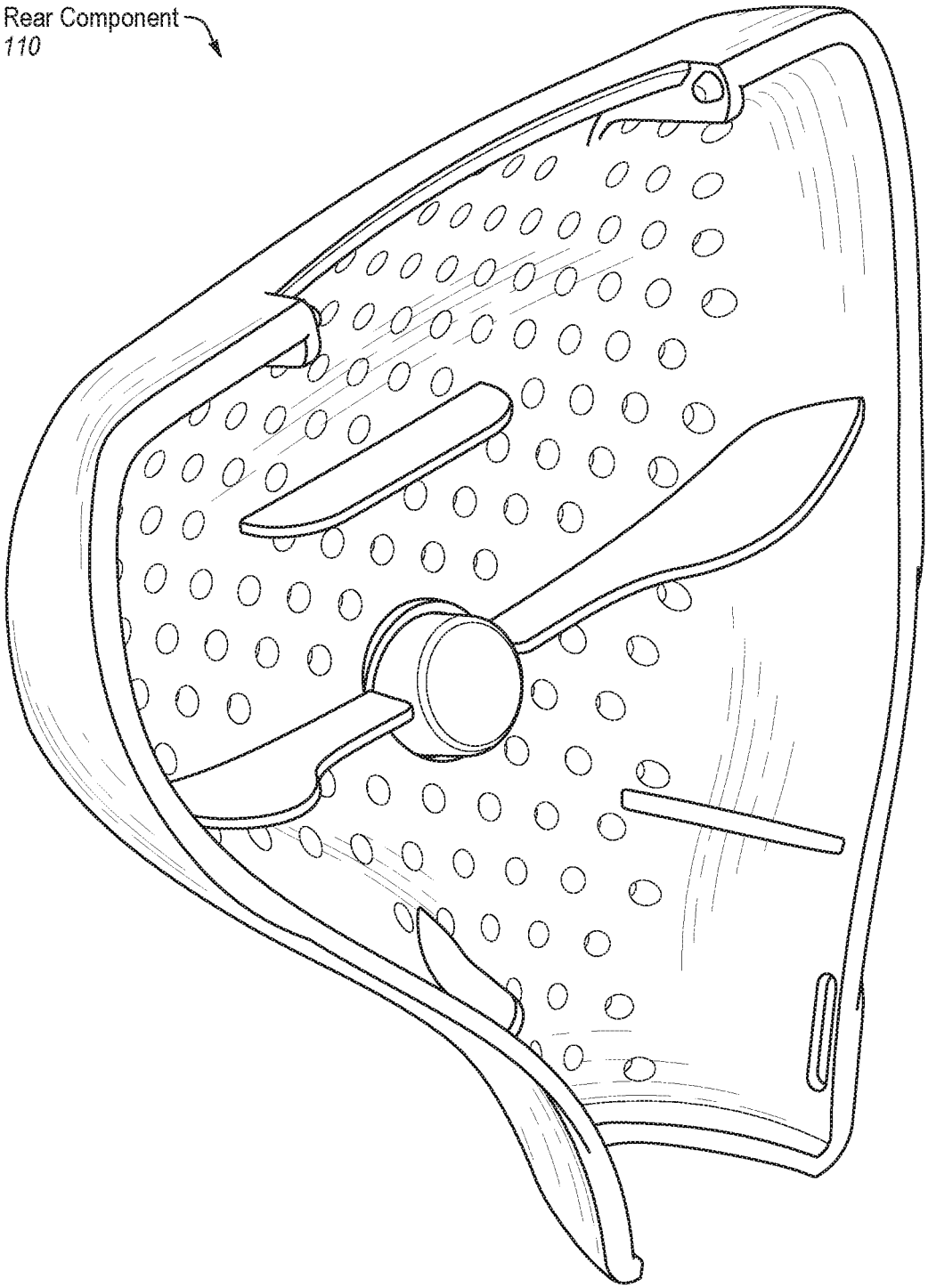
FIGS. 6A-H illustrate views of a rear component of a razor cover system, according to certain embodiments.
Figure 6B:
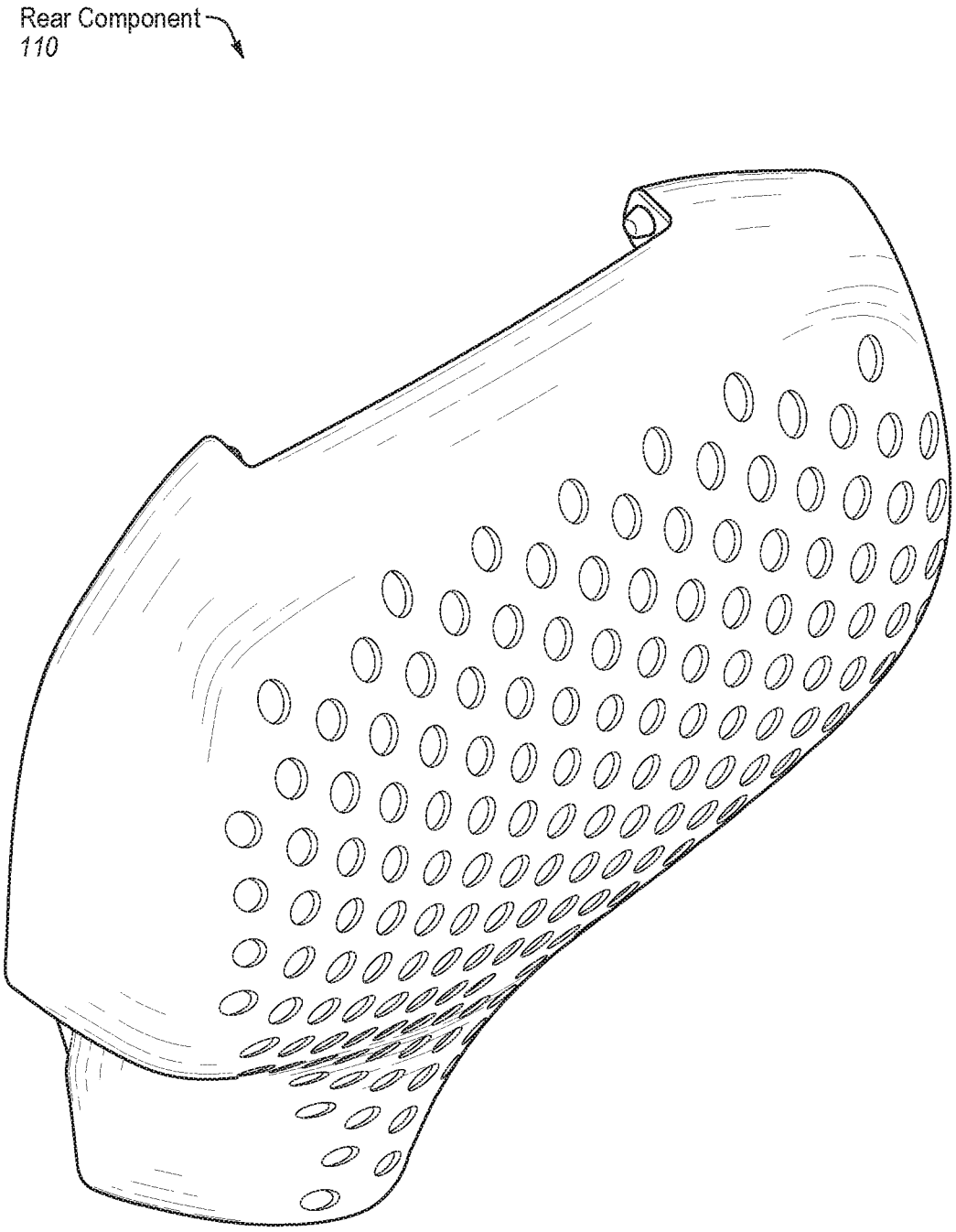
Figure 6C:
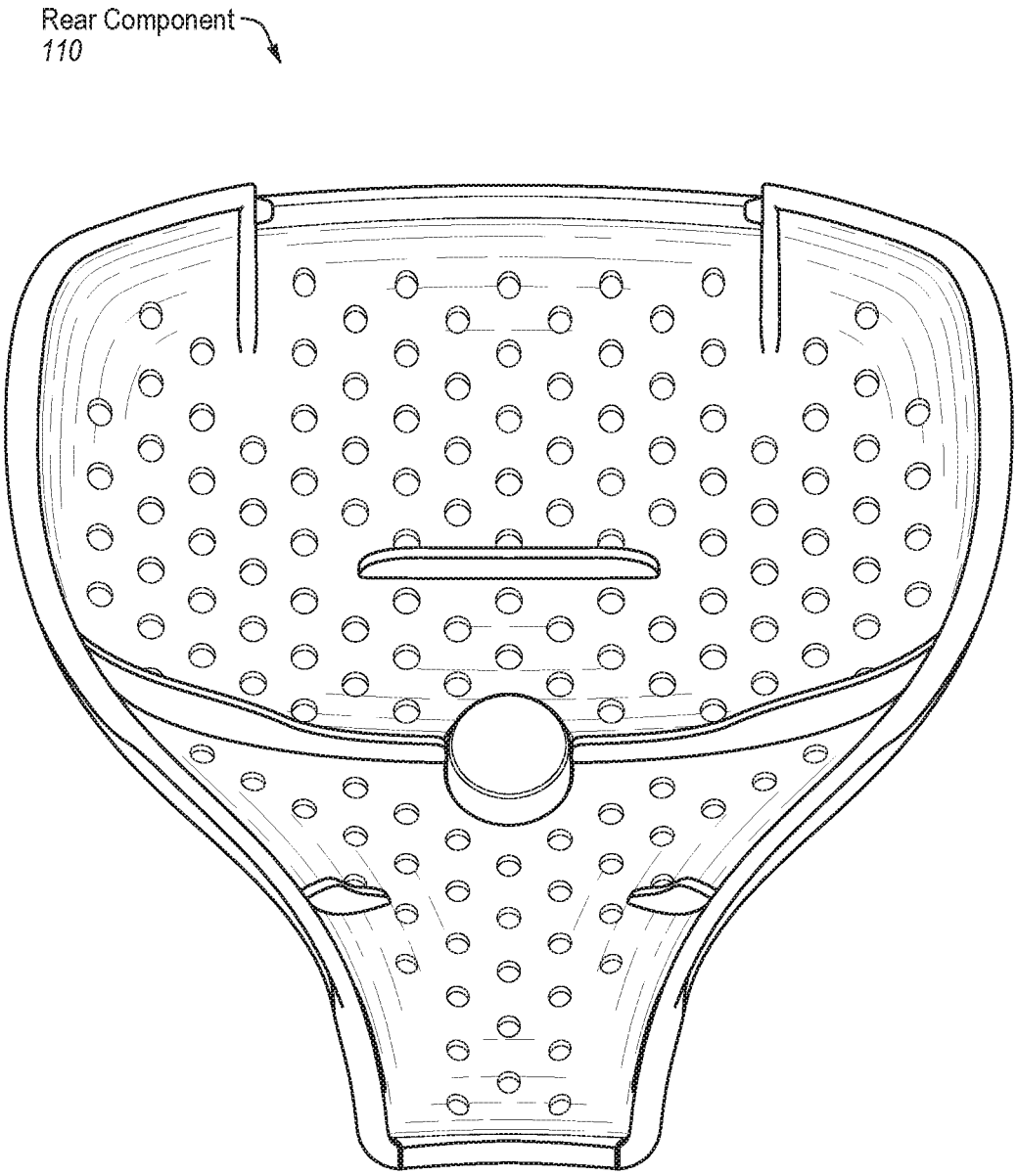
Figure 6D:
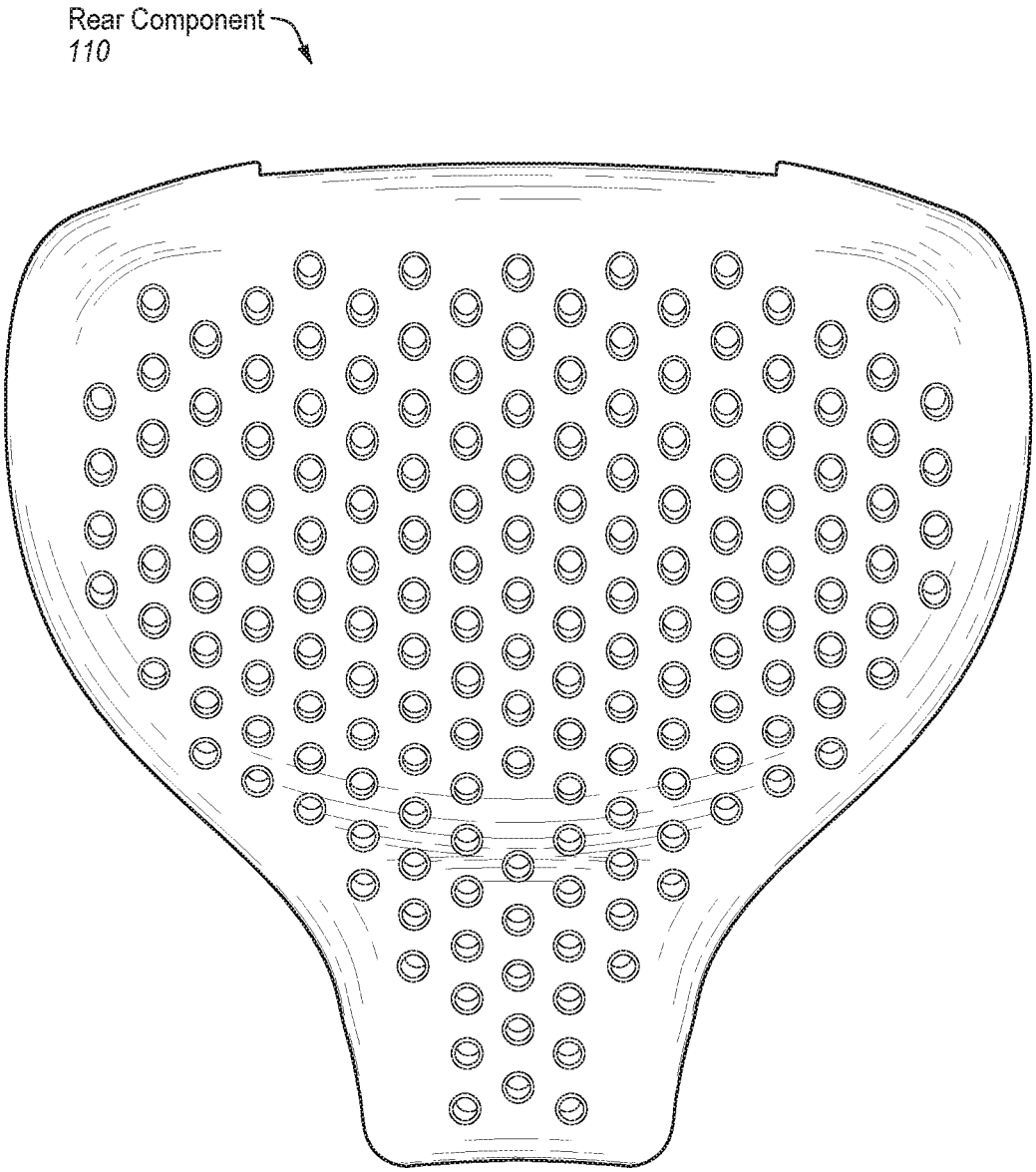
Figure 6E:
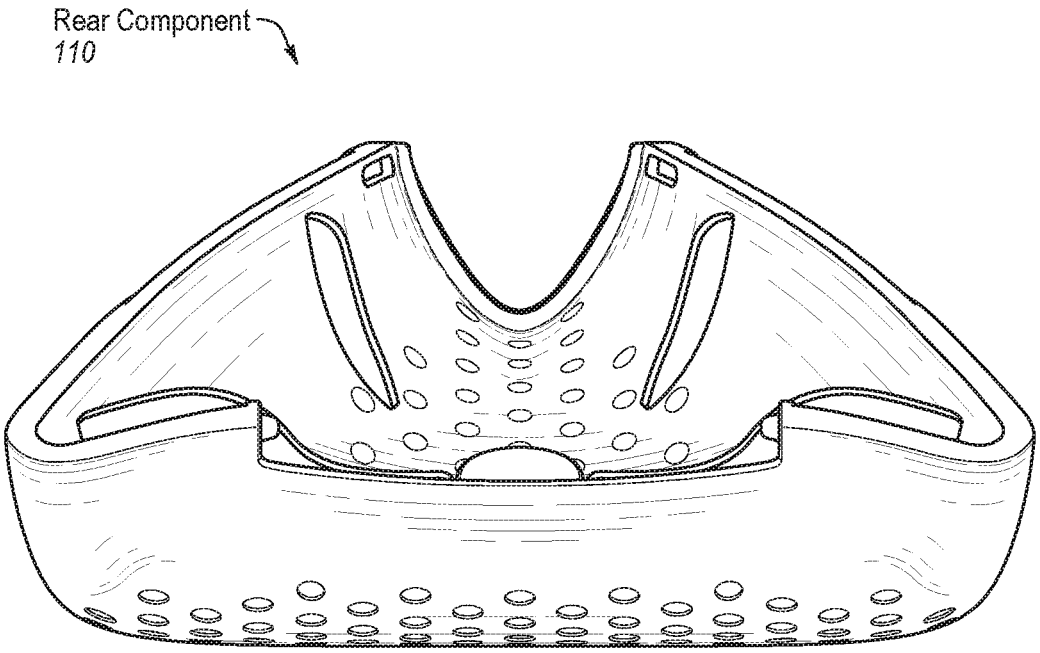
Figure 6F:
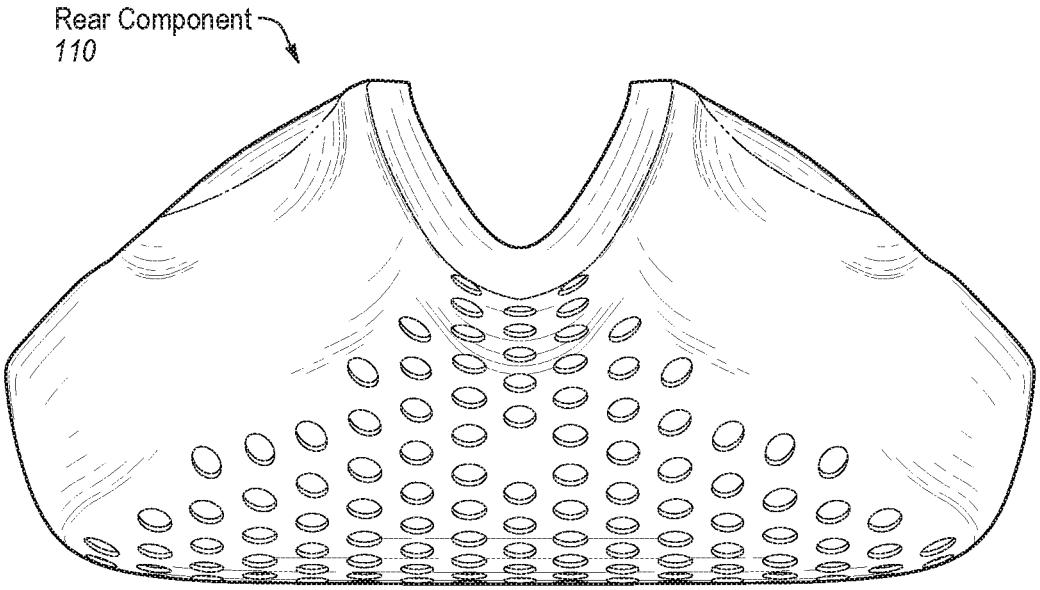
Figure 6G:
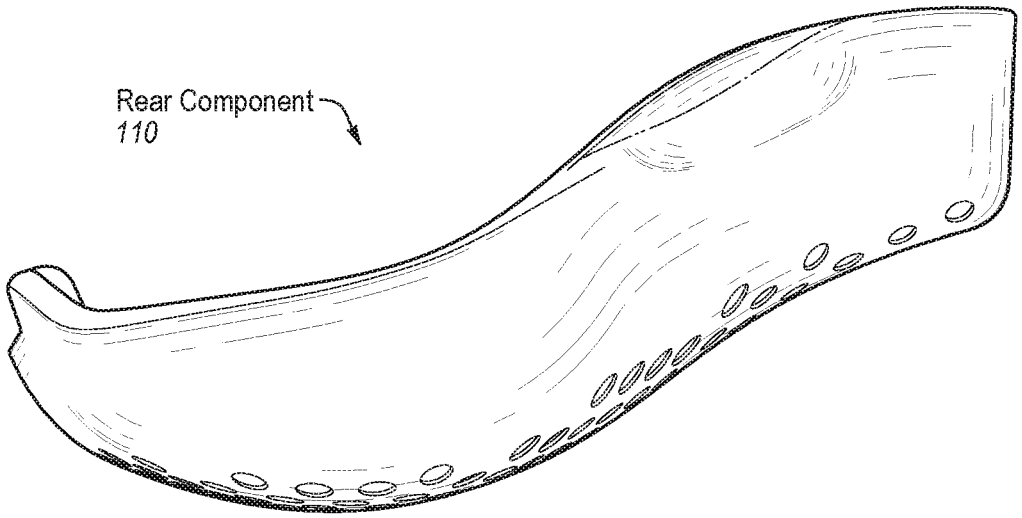
Figure 6H:
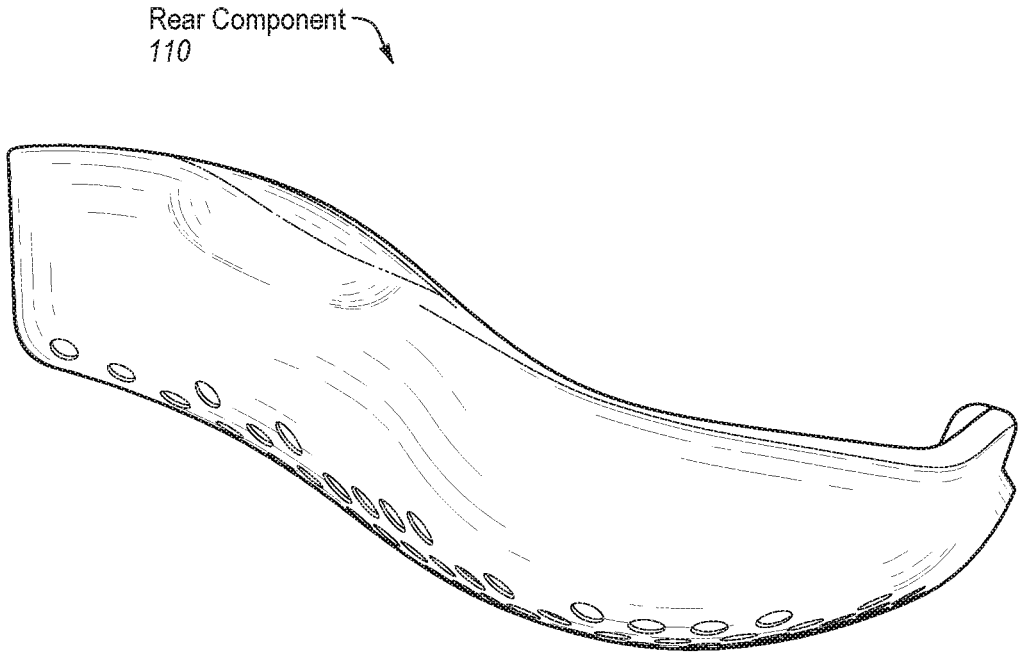

FIGS. 6A-H illustrate views of a rear component 110 of a razor cover system 100, according to certain embodiments. FIG. 6A may be a front perspective view, FIG. 6B may be a rear perspective view, FIG. 6C may be a front view, FIG. 6D may be a rear view, FIG. 6E may be a top view, FIG. 6F may be a bottom view, FIG. 6G may be a left side elevation view, and FIG. 6H may be a right side elevation view.

Figure 7A:
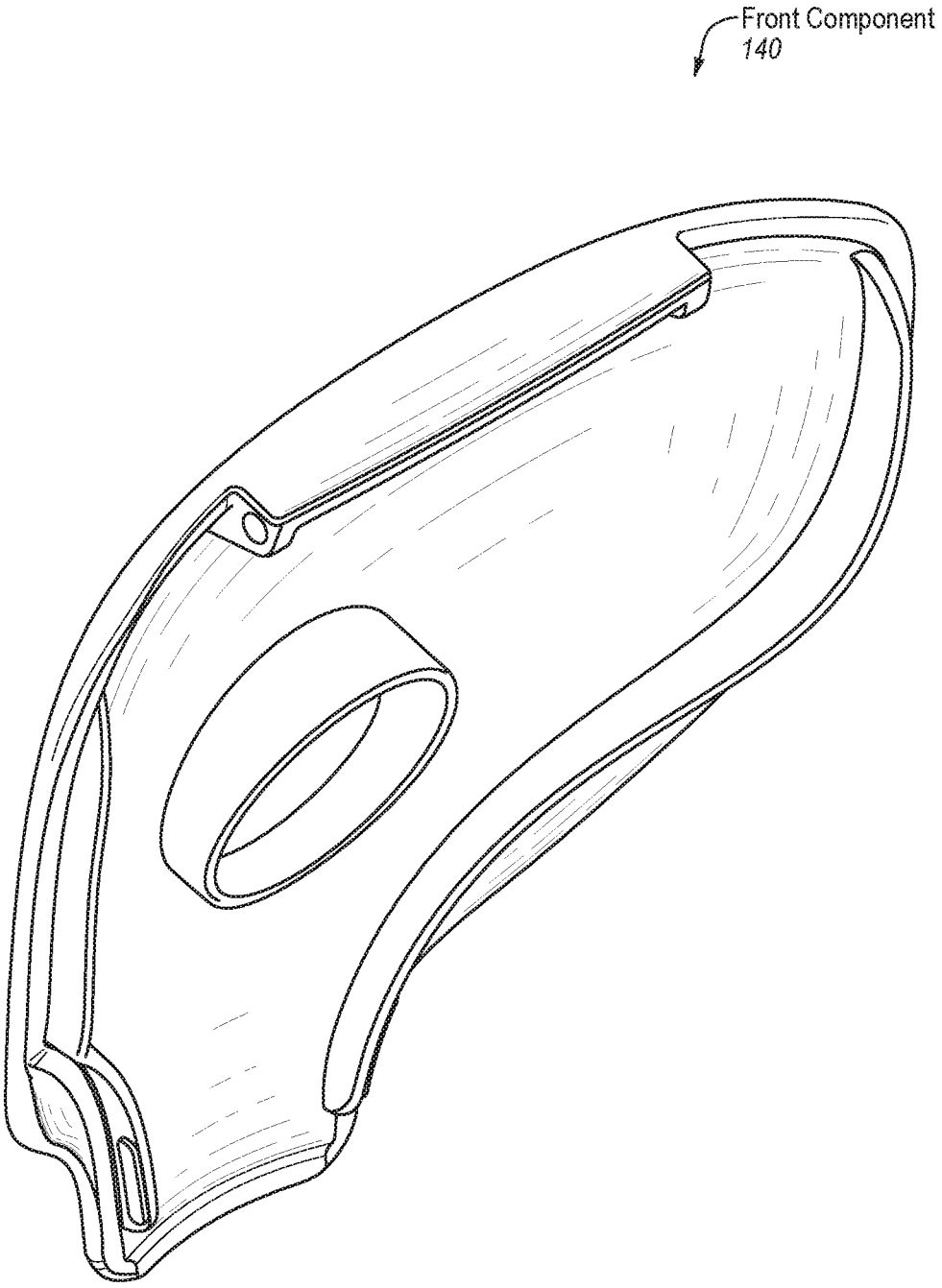
FIGS. 7A-F illustrate views of a front component of a razor cover system, according to certain embodiments.
Figure 7B:
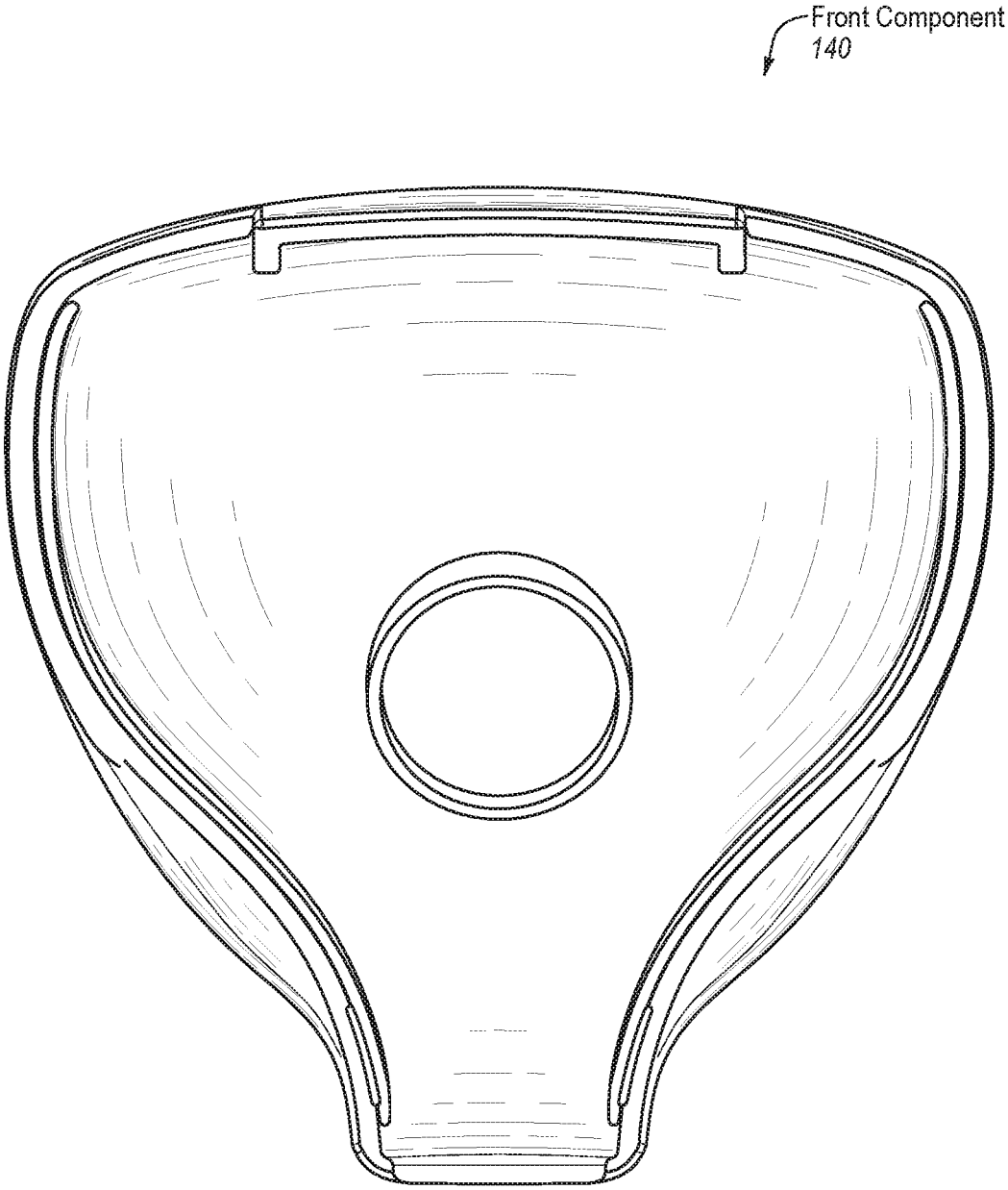
Figure 7C:
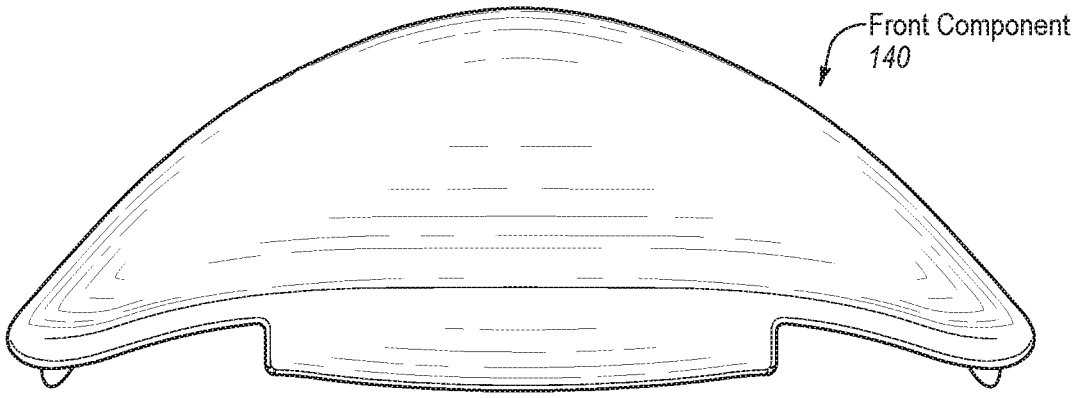
Figure 7D:
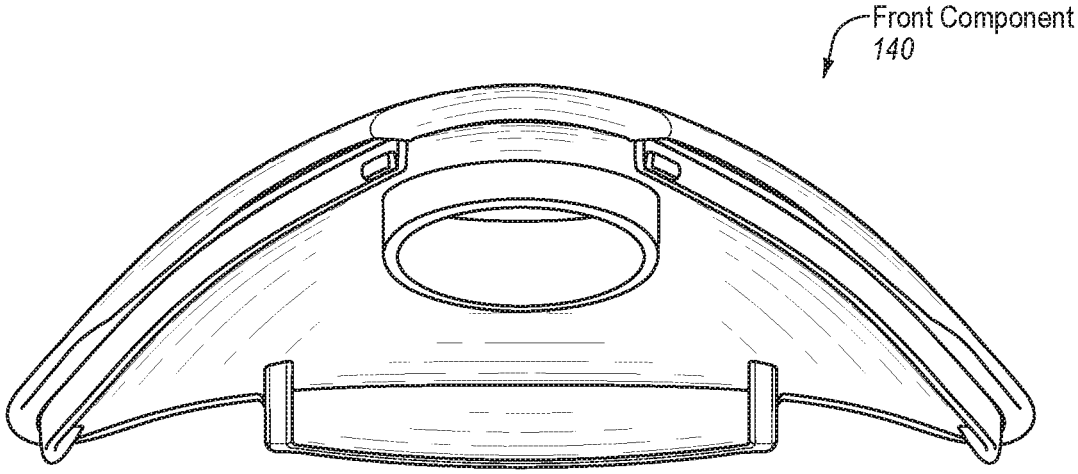
Figure 7E:
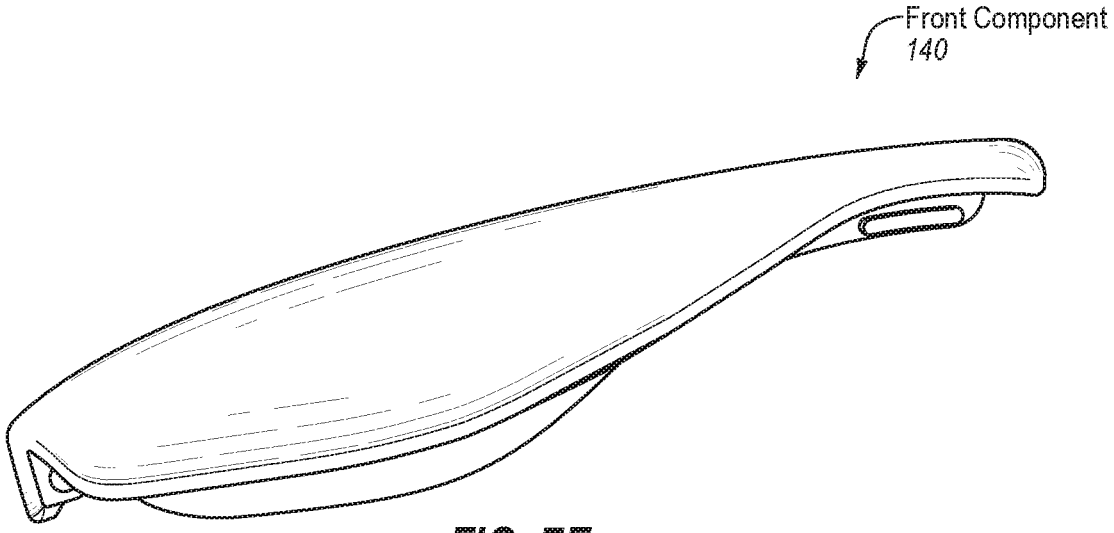
Figure 7F:
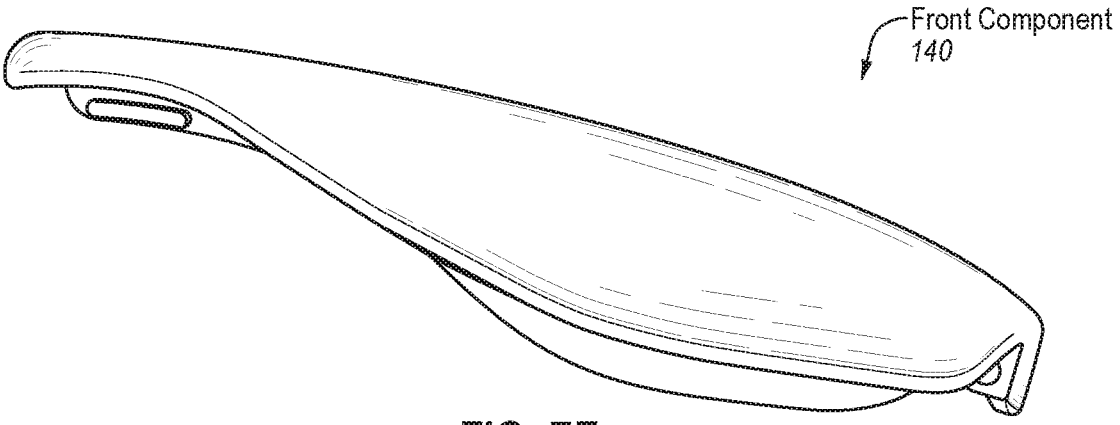

FIGS. 7A-F illustrate views of a front component 140 of a razor cover system 100, according to certain embodiments. FIG. 7A may be a rear perspective view, FIG. 7B may be a rear view, FIG. 7C may be a top view, FIG. 7D may be a bottom view, FIG. 7E may be a left side elevation view, and FIG. 7F may be a right side elevation view.

Figure 8:
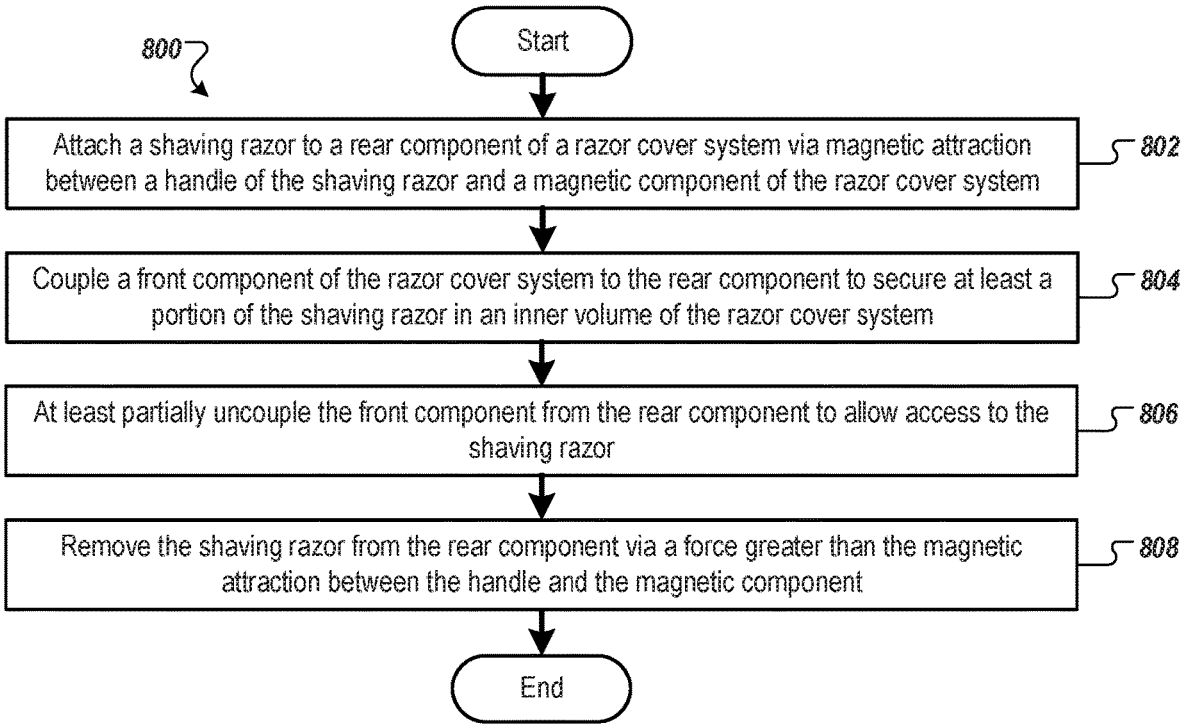
FIG. 8 illustrates a method associated with the razor cover system, according to certain embodiments.

FIG. 8 illustrates a method 800 associated with the razor cover system, according to certain embodiments. Although shown in a particular sequence or order, unless otherwise specified, the order of the operations can be modified. Thus, the illustrated embodiments should be understood only as examples, and the illustrated processes can be performed in a different order, and some processes can be performed in parallel. Additionally, one or more operations can be omitted in various embodiments. Thus, not all operations are required in every embodiment.

Referring to method 800 of FIG. 8, at block 802, a shaving razor is removably attached to a rear component of a razor cover system via magnetic attraction between a handle of the shaving razor and a magnetic component of the razor cover system. The magnetic component may be coupled to the rear component.

At block 804, a front component of the razor cover system is coupled with the rear component via a first interface of the rear component and a second interface of the front component to secure at least a portion of the shaving razor in an inner volume of the razor cover system between the front component and the rear component.

At block 806, the front component of the razor cover system is at least partially uncoupled from the rear component via the first interface of the rear component and the second interface of the front component to allow access to the shaving razor.

At block 808, the shaving razor is removed from the rear component via a force greater than the magnetic attraction between the handle and the magnetic component.

The terms "first," "second," "third," "fourth," etc. as used herein are meant as labels to distinguish among different elements and may not have an ordinal meaning according to their numerical designation.

The preceding description sets forth numerous specific details such as examples of specific systems, components, methods, and so forth in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

Reference throughout this specification to "one embodiment," "an embodiment," or "some embodiments" means that a particular feature, structure, or characteristic described in connection with the embodiment is included in at least one embodiment. Thus, the appearances of the phrase "in one embodiment," "in an embodiment," or "in some embodiments" in various places throughout this specification are not necessarily all referring to the same embodiment. In addition, the term "or" is intended to mean an inclusive "or" rather than an exclusive "or." When the term "about" or "approximately" is used herein, this is intended to mean that the nominal value presented is precise within ±10%.

Although the operations of the methods herein are shown and described in a particular order, the order of operations of each method may be altered so that certain operations may be performed in an inverse order so that certain operations may be performed, at least in part, concurrently with other operations. In another embodiment, instructions or sub-operations of distinct operations may be in an intermittent and/or alternating manner.

It is understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which such claims are entitled.

What is claimed is:

1. A razor cover system comprising:

a rear component;

a front component configured to couple with the rear component to form an inner volume of the razor cover system, wherein the inner volume is configured to receive a cartridge and a distal portion of a handle of a shaving razor proximal the cartridge when the rear component and the front component are decoupled, and wherein the cartridge and distal portion of the handle of the shaving razor proximal the cartridge are enclosed in the inner volume when the rear component and the front component are coupled; and a magnetic component coupled to an inner surface of the rear component within the inner volume, wherein the magnetic component extends from the inner surface of the rear component and is configured to secure a first portion of the handle of the shaving razor to the rear component without contacting the cartridge coupled to the handle.

2. The razor cover system of claim 1, wherein the rear component comprises a first support structure and a second support structure configured to contact one or more portions of the handle without contacting the cartridge.

3. The razor cover system of claim 2, wherein the front component comprises:

a pivoting interface;

a securing interface; and a third support structure that extends from an inner surface of the front component between the pivoting interface and the securing interface, wherein the third support structure is configured to contact a second portion of the handle of the shaving razor without contacting the cartridge, and wherein the shaving razor is to be secured between the first support structure and the second support structure of the rear component and the third support structure of the front component.

4. The razor cover system of claim 2, wherein the first support structure is configured to contact a third portion of the handle between a pivoting interface of the rear component and a securing interface of the rear component, and wherein the second support structure is configured to contact a fourth portion of the handle of the shaving razor between the first support structure and the securing interface of the rear component.

5. The razor cover system of claim 2, wherein:

the cartridge comprises razor blades; and a third support structure of the rear component is configured to contact a portion of the cartridge without contacting the razor blades.

6. The razor cover system of claim 5, wherein the third support structure is configured to contact the portion of the cartridge without contacting a lubrication portion of the cartridge.

7. The razor cover system of claim 1, wherein the rear component comprises a first interface and the front component comprises a second interface configured to couple with the first interface.

8. A razor cover system comprising:

a rear component comprising a first support structure and a second support structure configured to contact one or more portions of a handle of a shaving razor without contacting a cartridge coupled to the handle; and a front component comprising a third support structure configured to contact a second portion of the handle without contacting the cartridge, wherein the front component is configured to couple with the rear component to form an inner volume of the razor cover system, wherein at least a portion of the shaving razor is to be disposed in the inner volume of the razor cover system, and wherein the shaving razor is to be secured between the first support structure and the second support structure of the rear component and the third support structure of the front component.

9. The razor cover system of claim 8, wherein:

the rear component further comprises a first pivoting interface;

the front component further comprises a second pivoting interface configured to couple to the first pivoting interface; and the rear component and the front component are to be pivoted relative to each other via the first pivoting interface and the second pivoting interface to allow access to the shaving razor.

10. The razor cover system of claim 9, wherein:

the rear component further comprises a first securing interface;

the front component further comprises a second securing interface configured to couple to the first securing interface; and the rear component and the front component are to be secured to each other via the first securing interface and the second securing interface around a first portion of the handle to secure the at least a portion of the shaving razor within the inner volume of the razor cover system.

11. The razor cover system of claim 10, wherein:

the third support structure of the front component extends from an inner surface of the front component between the second pivoting interface and the second securing interface;

and the second portion of the handle is disposed between the cartridge and the first portion of the handle.

12. The razor cover system of claim 10 further comprising:

a magnetic component configured to couple to an inner surface of the rear component within the inner volume proximate at least one of the first support structure or the second support structure, wherein the magnetic component extends from the inner surface of the rear component and is configured to secure a third portion of the handle to the rear component without contacting the cartridge, and wherein the third portion of the handle is disposed between the cartridge and the first portion of the handle.

13. The razor cover system of claim 8, wherein:

the cartridge comprises razor blades; and a fourth support structure of the rear component is configured to contact a portion of the cartridge without contacting the razor blades.

14. The razor cover system of claim 13, wherein the fourth support structure is configured to contact the portion of the cartridge without contacting a lubrication portion of the cartridge.

15. A method comprising:

removably attaching a shaving razor to a rear component of a razor cover system via magnetic attraction between a first portion of a handle of the shaving razor and a magnetic component of the rear component, the handle having a first distal end and a second distal end opposite the first distal end, a cartridge being coupled to the first distal end, wherein the first portion of the handle is proximate the first distal end, wherein a first support structure and a second support structure of the rear component contact the handle without contacting the cartridge responsive to the removably attaching of the shaving razor to the rear component; and coupling a front component of the razor cover system to the rear component to enclose at least a portion of the shaving razor in an inner volume of the razor cover system.

16. The method of claim 15 further comprising:

at least partially uncoupling the front component from the rear component to allow access to the shaving razor; and removing the shaving razor from the rear component via a force greater than the magnetic attraction between the handle and the magnetic component.

17. The method of claim 15, wherein the coupling of the front component to the rear component to enclose the at least a portion of the shaving razor comprises securing the shaving razor between the first support structure and the second support structure of the rear component and a third support structure of the front component.

18. The method of claim 17, wherein the first support structure of the rear component contacts a second portion of the handle between a pivoting interface of the rear component and a securing interface of the rear component, and wherein the second support structure is configured to contact a third portion of the handle of the shaving razor between the first support structure and the securing interface of the rear component.

19. The method of claim 18, wherein:

the cartridge comprises razor blades; and a fourth support structure of the rear component is configured to contact a portion of the cartridge without contacting the razor blades.

20. The method of claim 15, wherein the first portion of the handle is proximate one or more razor blades of the shaving razor.

* * * * *